US005259605A

United States Patent [19]

Yoshie et al.

[11] Patent Number: 5,259,605

[45] Date of Patent: Nov. 9, 1993

[54] SORTER WITH TRAYS HAVING GUIDE PLATES AND RETURN SPRINGS

[75] Inventors: Kohji Yoshie; Norio Jouichi; Masanobu Kawano; Yoshikazu Maekawa; Osamu Murata; Junzi Sato; Kazuhiro Hirota; Hisao Hosoya, all of Hachioji, Japan

[73] Assignee: Konica Corporation, Tokyo, Japan

[21] Appl. No.: 815,080

[22] Filed: Dec. 27, 1991

[30] Foreign Application Priority Data

Jan. 14, 1991 [JP] Japan ..... 3-002764
Jan. 16, 1991 [JP] Japan ..... 3-014897
Apr. 12, 1991 [JP] Japan ..... 3-080064

[51] Int. Cl.[5] ..... B65H 39/02; B42B 2/00
[52] U.S. Cl. ..... 270/53; 270/58
[58] Field of Search ..... 270/37, 53, 58

[56] References Cited

U.S. PATENT DOCUMENTS 3,995,748 12/1976 Looney ..... 270/53
4,376,529 3/1983 George ..... 270/53
4,382,592 5/1983 Harding ..... 270/53
4,564,185 1/1986 Hamlin ..... 270/53
4,605,211 8/1986 Sonobe ..... 270/53
5,031,890 7/1991 Hosoi ..... 270/53
5,092,509 3/1992 Naito et al. ..... 270/53 X
5,114,130 5/1992 Hamanaka et al. ..... 270/53
5,137,266 8/1992 Mori et al. ..... 270/53

*Primary Examiner*—Edward K. Look
*Assistant Examiner*—John Ryznic
*Attorney, Agent, or Firm*—Frishauf, Holtz, Goodman & Woodward

[57] ABSTRACT

A sorter, which sorts sheets transferred from an image forming apparatus to form a plurality of sheet stacks and staples each sheet stacks, is disclosed herewith. The sorter is provided with a plurality of bins arrayed in an upright direction for stacking the sorted sheets, and is provided also with a stapler to staple each sheet stack. The bin is adapted to swing horizontally between a first angular position to stack the sorted sheets and a second angular position to undergo the stapling of the sheet stack by the stapler. The stapler is adapted to move along the upright direction through a plurality of stapling positions, and staples each sheet set at each stapling position.

13 Claims, 20 Drawing Sheets

FIG. 13-a
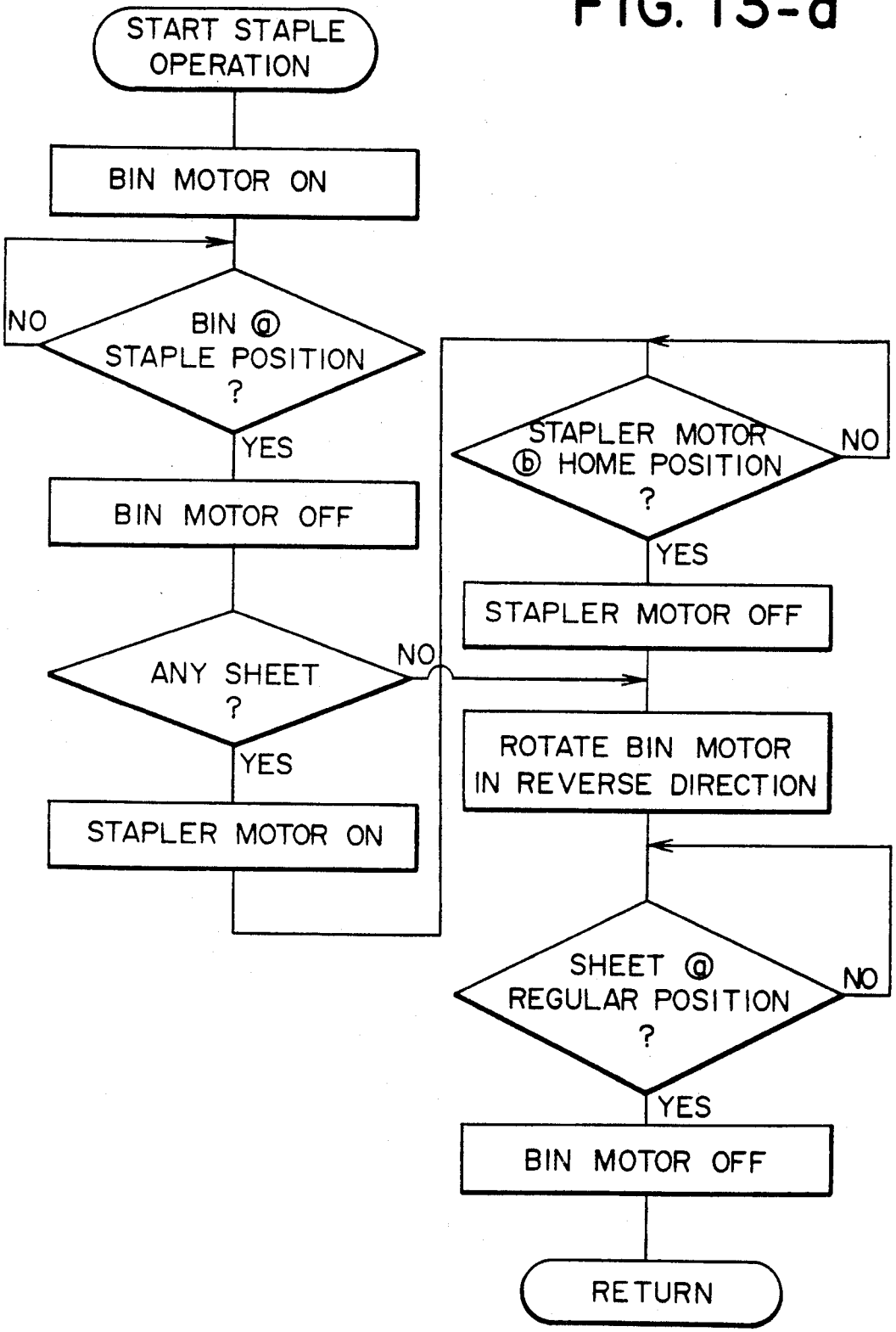

FIG. 13-b
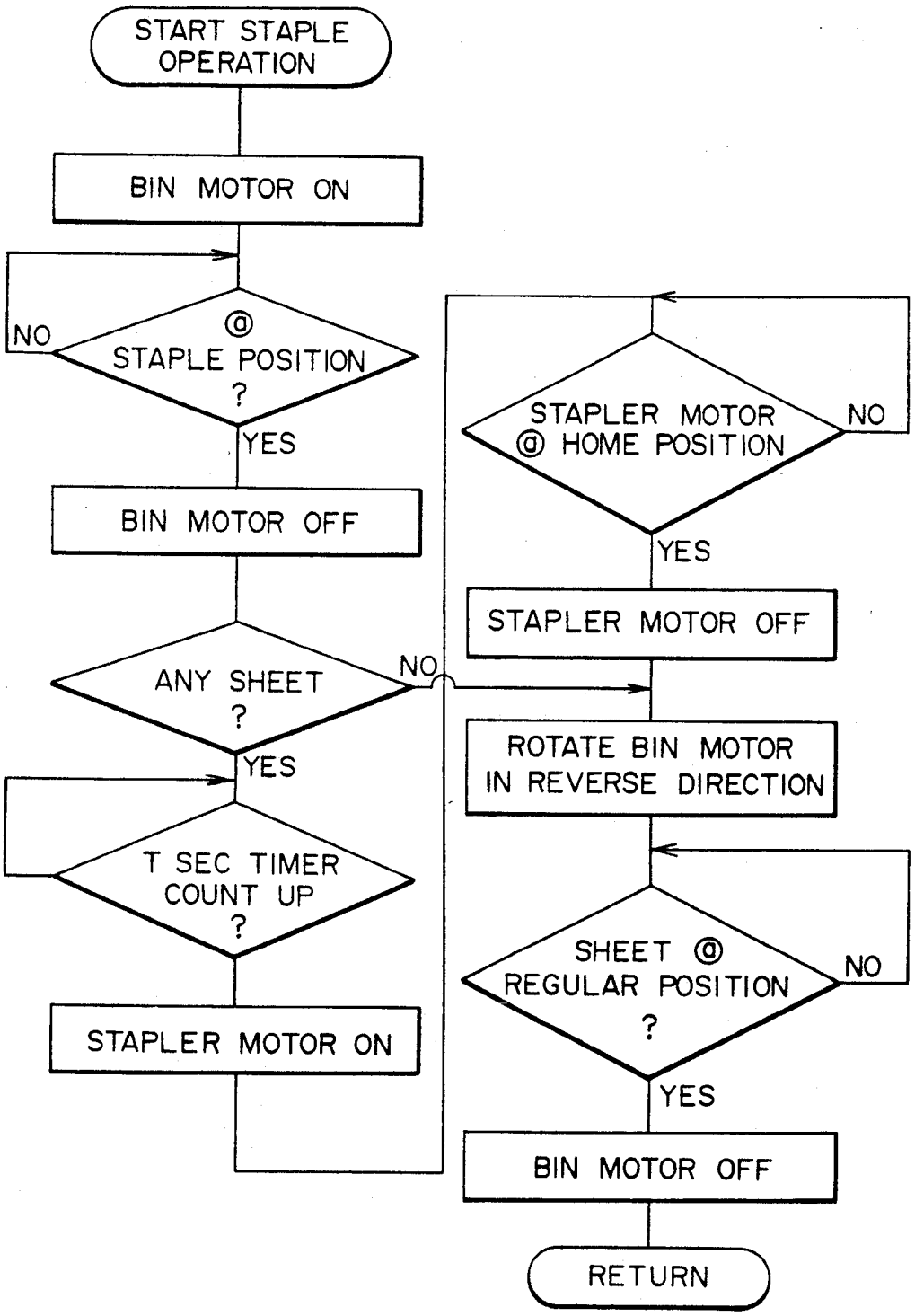

SORTER WITH TRAYS HAVING GUIDE PLATES AND RETURN SPRINGS

BACKGROUND OF THE INVENTION

The present invention relates to a sorter which is installed in an image forming apparatus such as a copying machine, a printing machine or a laser beam printer and receives sheets ejected from the image forming apparatus after separating and sorting them, and more particularly, to a sorter equipped with a number of bins and with a stapler unit that staples sheets stacked on each bin after aligning the edges of the sheets.

Heretofore, as a sheet finisher equipped with a stapler unit that staples sheets ejected from a copying machine or the like, there has been a sheet finisher which is used together with a machine such as an automatic recirculating document handler (RDH) or the like and staples each stack of sheets. Such a sheet finisher, however, has a drawback that its structure is complicated and its cost is high.

(1) In Japanese Patent Publication Open to Public Inspection No. 43457/1989 (hereinafter referred to as Japanese Patent O.P.I. Publication), has disclosed an apparatus in which a stapling device is provided to a relatively simple bin-moving type of sorter. In the aforementioned apparatus, a stapling device to staple sheets sorted into a bin can be freely moved with regard to the bin.

(2) Another sorter is composed in such a manner that: a fixed type of stapling device is provided to each bin; and the bin is moved to the stapling position so that a stack of sheets can be stapled.

(3) A sorter disclosed in Japanese Patent O.P.I. Publication No. 244869/1987, is composed in such a manner that: a bin having sheets is moved horizontally and straight to a position where a stapling operation can be conducted; the sheets are stapled by a stapling device; and when the sheets in other bins are stapled, the stapling device is moved in a vertical direction.

In the aforementioned sorter of case (1) having a stapling device which can be moved freely, the moving stroke of the stapling device is different according to sheet size. Accordingly, when vertical spacing of each bin is set large, the sorter size becomes large as a whole, and when vertical spacing of a bin into which the stapling device is inserted, is extended, the mechanism becomes complicated.

In the aforementioned sorter of case (2), the structure of the sorter is complicated as a whole, and in the case where a vertical spacing of the bin is small, a special stapling device is required.

In the aforementioned sorter of case (3), each bin in which sheets are put, is moved straight along a bin guide at an appropriate time. Accordingly, it is disadvantageous in that the structure becomes complicated.

In any of the sorters mentioned above, considerably long time is needed for the period from delivery of a sheet from the image forming apparatus into each bin to the completion of stapling.

Further, in the conventional system, a stapler is moved toward the bin for the succeeding stapling after a certain predetermined period of time has passed from the completion of the preceding stapling operation. Therefore, even when a stack of stapled sheets has not returned to the right position due to the phenomenon that the sheets in a stack are bent or caught, the stapler is forcibly caused to start moving after the predetermined time has passed, resulting in the possibility that the stapler may hit the bin or paper jamming may be caused.

The following two methods are generally used for moving a moving body up and down vertically.

(1) Two wires suspend the moving body, and a driving means connected to the wires drives the moving body in a vertical direction.

(2) Rotatable rollers are provided on a moving body so that the rollers slide on fixed guide rail surfaces and the moving body is suspended with a single chain.

When the conventional methods for moving up and down the moving body mentioned above, are used as a means for moving up and down a stapler, the following problems are caused.

In the method (1) wherein a moving body is suspended with two wires, a play between the moving body and an outer body is large and the moving body is apt to swing, resulting in an unstable stopping position of the body and consequent dispersion in the stapling position on sheets.

In the method (2) wherein rollers and guide rails are used for moving a unit body, the play is also large, resulting in a great disparity in the stapling position on sheets, which is a serious problem.

The play is a problem for both methods of (1) and (2), and when a guide rail or the like is provided additionally for eliminating the play, the sliding friction for the vertical movement of the unit body is caused and a motor having a large torque is required, which is a problem.

SUMMARY OF THE INVENTION

An object of the invention is to solve the problems mentioned above and to provide a sorter with a stapling device which is simple in structure and reliable in operation. Another object of the invention is to provide a driving unit for vertical movement of a stapler that is simple in structure, reliable in operation with less play and low in cost, and thereby to realize a sorter equipped with a stapling device, the stapling position of which may be accurate and stable.

Further another object of the invention is to provide a sorter wherein a stapler can advance to the following stapling operation only after the confirmation that a stack of sheets has returned to the specified position, and thereby accidental touch between the stapler and a bin as well as paper jamming may be prevented.

In a sorter which sorts transferred sheets from an image forming apparatus into sheet sets, stacks the sheet sets on a plurality of bins and staples the sheet sets, the present invention comprises the following components.

(1) a supporting shaft fixed to the main body of the sorter in an upright position for rotatably supporting the plurality of bins at regular intervals.

(2) a hole provided through the bin at a portion near one end of the bin, through which the supporting shaft is inserted, thereby the hole functions as the center of rotation of the bin.

(3) a peripheral portion of the bin on the other end of the bin to which force is applied to rotate the bin.

(4) means for rotating the bin from a stacking position to a stapling position by pushing the peripheral portion, in which the stacking position is suited to receive the recording sheet and the stacking position is suitable for the sheet stack to undergo the stapling.

(5) a stapling unit movable to a plurality of stapler positions along an upright direction.

(6) means for detecting a trailing edge of the sheet.

(7) counter means for counting a number of sheets transferred to each bin, wherein the acceptance of the last sheet by each bin is acknowledged by the logical product of the detection of the trailing edge and a counting up of a predetermined number of sheets to be stacked on each bin.

Further, in the present invention, when two bins named herein a former bin and a successor bin are to end the acceptance of the last sheet in succession, the swinging means starts to swing the former bin towards the stapling position in response to the acknowledgement of the acceptance of the last sheet in the successor bin.

Furthermore, the sorter of the present invention is characterised in that, in stapling a sheet set stacked on a bin, the bin starts to rotate towards the stapling position after the stapler having moved to the stapling position, and the stapler starts to move towards a next stapling position when the bin is detected to have returned to the stacking angular position after the stapling.

Furthermore, the sorter of the present invention is characterised in that it comprises: an integral stapler unit which includes the swinging means and the stapler; a stick of pipe fixed to the main body of the sorter in an upright direction; a guide rail fixed to the main body of the sorter in parallel to the pipe, which, together with the pipe, guides the stapler unit to move along the upright direction; a string of chain for suspending the stapler unit; and a driving unit for moving the stapler unit by driving the chain.

Further, in a sorter with a stapler wherein a stapler is positioned at a stapling position for a specific bin loaded with a stack of sheets, and the stack of sheets in the specific bin are moved to the aforementioned stapling position for undergoing a stapling operation of the aforementioned stapler, and then the stapler mentioned above is moved to the other bin for the same operation of stapling, the aforementioned stapler is moved to the following stapling position only after the detection that the aforementioned stack of sheets stapled already have returned to their original position, due to the invention. body of the aforesaid sorter is held to be movable in a vertical direction by a hollow pipe member supported vertically and solidly in the aforesaid sorter main body and by a guide rail member arranged in parallel with the hollow pipe member, and is connected to the wire connected to a driving means so that the elevator member may be moved up and down.

Further, the sorter with a stapler device of the invention is characterized in that the aforesaid driving means is provided at the upper position of the sorter main body.

The sorter of the invention is further characterized in that a weight for the purpose of a counterbalance is affixed at a certain point on the wire connected to the aforementioned driving means.

BRIEF DESCRIPTION OF THE DRAWINGS

FIG. 13*a* is a flow chart of stapling control in the above example, and FIG. 13*b* is a flow chart showing a variety of stapling control in the second example.

FIGS. 14–20 show the third example wherein

FIG. 14 is a schematic diagram of a sorter attached to an image forming apparatus, FIG. 15 is a partial sectional view showing the upper and lower portions of the sorter, FIG. 16 is a perspective view of a bin, FIG. 17 is a plan view of the bin and a bin-swinging device, FIG. 18 is a perspective view of an elevator device for a unit body, FIG. 19 is a plan view showing the straight movement of the bin, and FIG. 20 is a plan view showing swinging process for the bin.

DETAILED DESCRIPTION OF THE PREFERRED EMBODIMENTS

With reference to the drawings, the embodiment of the present invention will be explained as follows.

Figure 1:
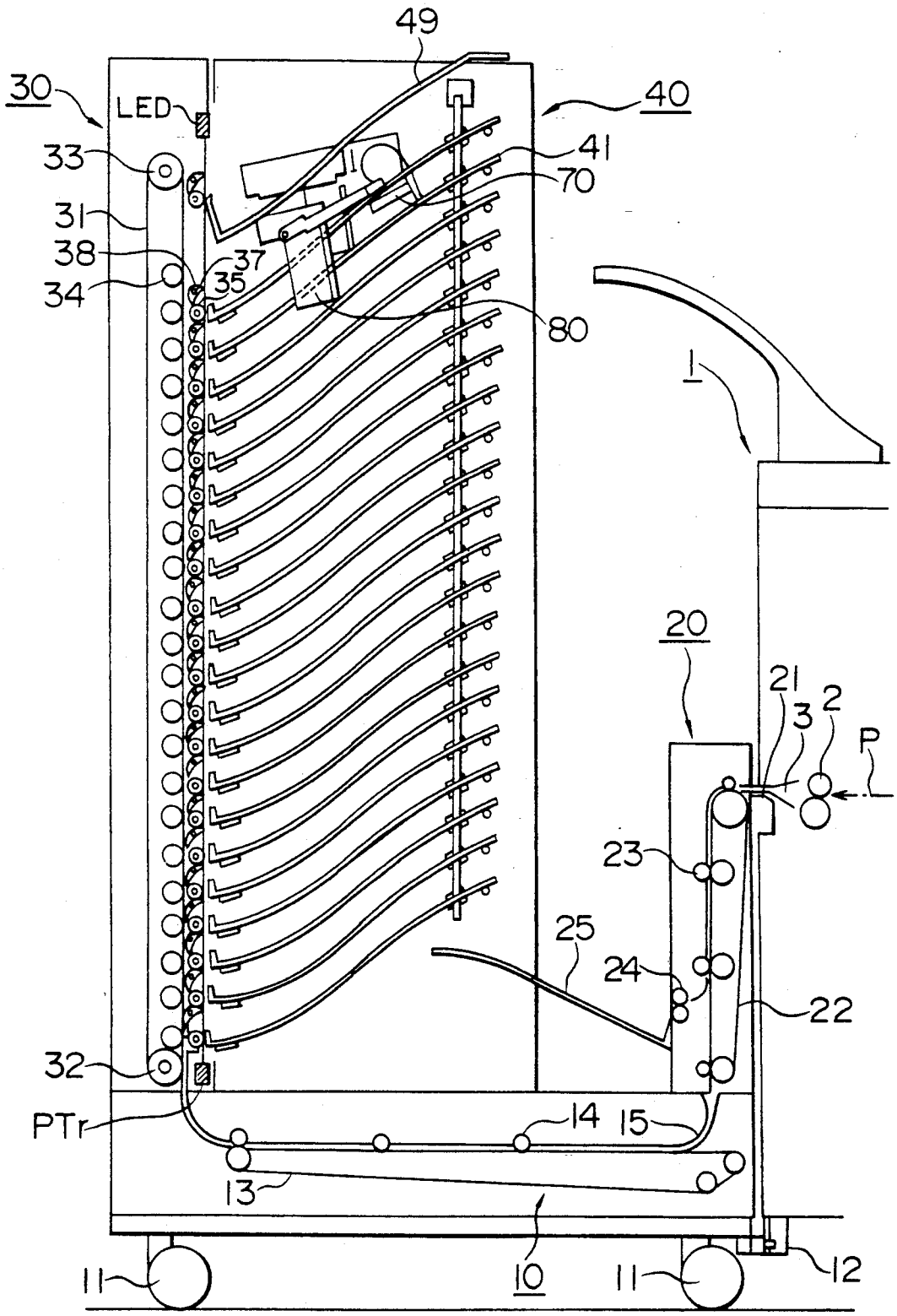
FIG. 1 is a schematic diagram of a sorter attached to an image forming apparatus.

FIG. 1 is a view showing the structure of the first example of a sorter of the invention which is connected with a main body 1 of an image forming apparatus (for example, a copying machine). The sorter of the present invention comprises a base frame 10, downward conveyance section 20, upward conveyance section 30, and bin shift section 40.

The base frame 10 includes a caster 11, connecting means 12 to connect the base frame 10 with a recording unit, conveyance belt 13, idle roller 14, guide plates 15, and drive means (not shown in the drawing), and the base frame 10 is fixed to the floor.

The downward conveyance section 20 is connected with sheet ejection rollers 2 and sheet ejection port 3 of the image forming apparatus 1. The downward conveyance section 20 is composed of a guide plate 21 to receive ejected sheet P so that it can be conveyed downward, a conveyance belt 22 and idle rollers 23 to convey sheet P to the conveyance belt 13 in the aforementioned base frame 10, and the like. A conveyance means 24 and tray 25 are branched from the conveyance passage, which are utilized for ejecting a preceding sheet in the image forming apparatus 1 when a jam has occurred in an ADF or a sorter. The upper portion of the frame corresponding to the aforementioned downward conveyance section 20 is freely opened and closed so that a jammed sheet in the downward conveyance section 20 can be removed.

In the upper conveyance section 30, an endless conveyance belt 31 is provided between pulleys 32 and 33 which are rotatably mounted on the upper and lower portion of the support frame. A plurality of rollers 34 corresponding to the insert ports of the bins are provided inside the conveyance belt 31 in such a manner that the rollers 34 are rotatably contacted with the conveyance belt 31. A plurality of conveyance rollers 35 are provided outside the conveyance belt 31 correspondingly to the rollers 34 in such a manner that the conveyance rollers 35 are rotatably contacted with the conveyance belt 31.

Branch guides 36 are disposed between the conveyance rollers 35 at the entrances of the bins, and oscillated to guide the sheets. These branch guides 36 are rotatably supported by shafts 37 which are provided to the aforementioned support frame, and oscillated by levers provided at the ends of shafts 37 and solenoids, wherein the levers and solenoids are not illustrated in the drawing. Accordingly, when the branch guide 36 is rotated clockwise, the lower edge claw portion of the branch guide 36 is crossed with a sheet conveyance passage composed of the conveyance belt 31 and the conveyance roller 35 so that the sheet can not be conveyed upward. In this way, the branch guide 36 is prepared for receiving sheets. When sheet P is conveyed under the aforementioned condition, sheet P is curved along the inner curved surface of the branch guide 36 in the direction of a right angle, and sheet P is received by bin 41.

Figure 2:
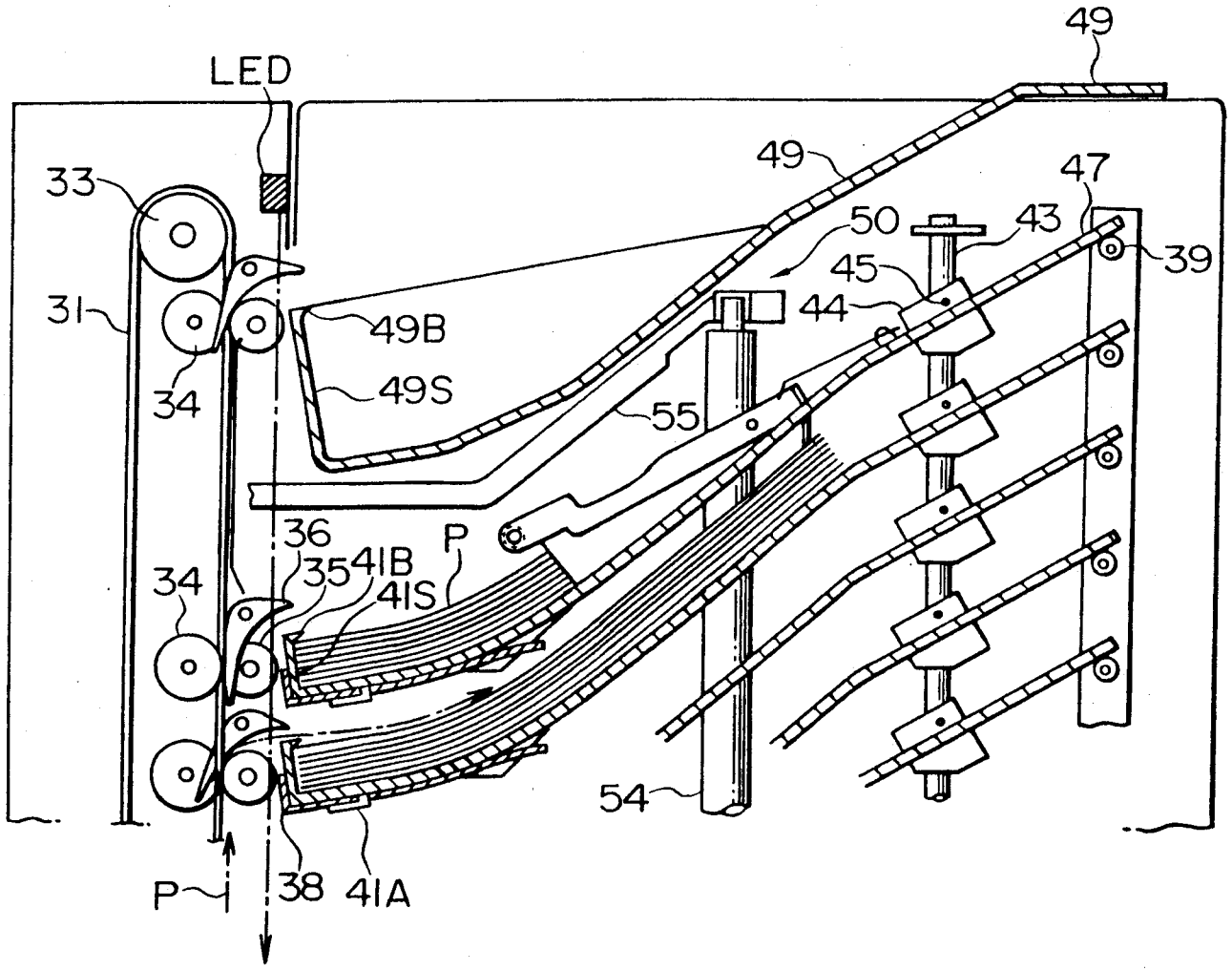
FIG. 2 is a cross-sectional view of both a composing member for a sheet-separating path and an upper bin of the sorter.
Figure 3:
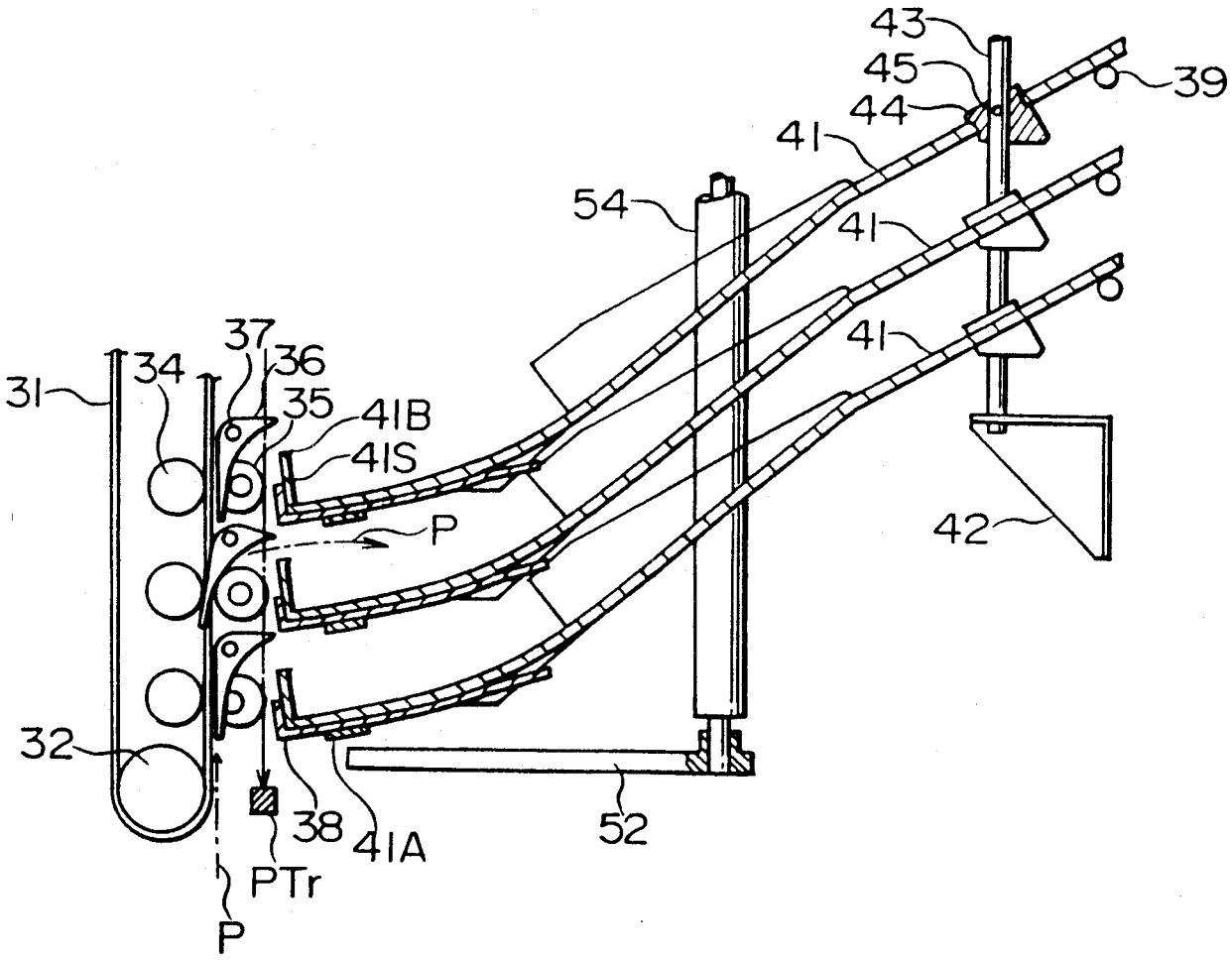
FIG. 3 is a partial cross-sectional view of a lower portion of the sorter.
Figure 4:
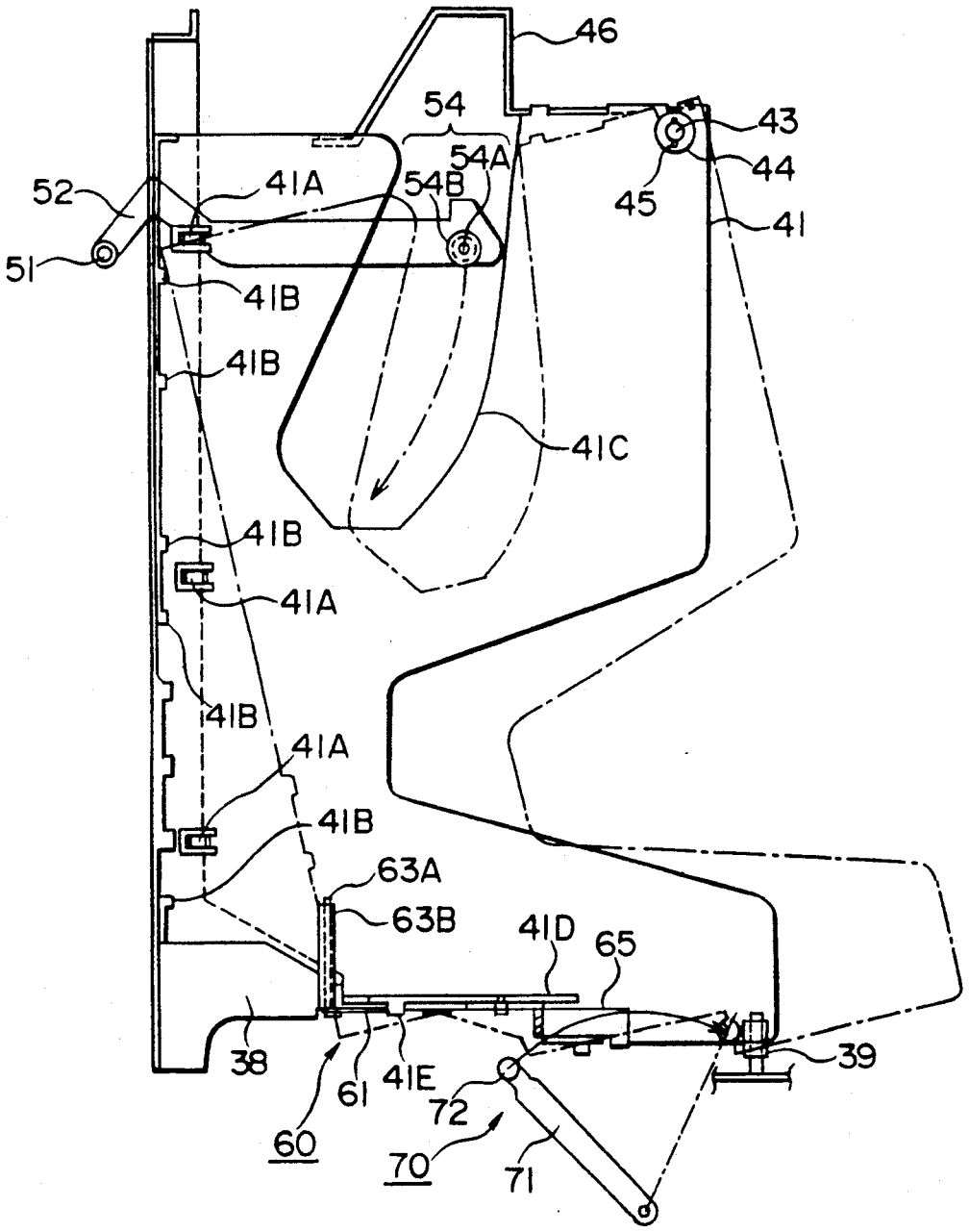
FIG. 4 is a plan view of both a bin and an alignment device.

FIG. 2 and FIG. 3 are partial sectional views of the composing members of the aforementioned branch conveyance passage and the bin. FIG. 2 shows the upper portion of the sorter, and FIG. 3 shows the lower portion of the sorter. FIG. 4 is a plan view of bin 41.

In the bin shift section 40, a plurality of bins (for example, 20 bins) 41 which are disposed at regular intervals, are supported in such a manner that the bins can be freely oscillated. That is, the bottom portion (the left portion shown in FIGS. 2 and 3 of the bin 41 is supported in a slidable manner on a guide plate 38 which is fixed to the bin shift section 40.

A vertical fixed shaft 43 which is supported by supporting members 42 mounted on the upper and lower portions of the frame of the bin shift section, is engaged with slide member 44 which is positioned by pin 45. The slide member 44 is inserted into a hole formed at one end (the right upper portion shown in FIGS. 2 and 3) of the aforementioned bin 41, so that the bin 41 can be freely rotated. The pins 45 mounted on the fixed shaft 43 at regular intervals, are engaged with the cut-out portions of the slide members 44, so that the bins 41 are held in parallel at regular intervals.

The end portion of the bin 41 is supported by rotatable roller 39 which is mounted on a portion of the frame of the bin shift section 40. In the manner described above, the bin 41 is supported by the guide plate 38, slide member 44 and roller 39, and freely rotated around the fixed shaft 43. The numeral 41A in the drawing represents 3 claws which engage with cut-out portions of the guide plate 48. The numeral 41B represents 5 front stoppers provided on the sheet guide side of the upper surface of the bin 41. The upper edge of the vertical surface of the stopper is curved so that it can be formed claw-shaped in order to prevent a sheet from getting out of the bin in the case where the trailing edge of the sheet is raised.

Figure 5:
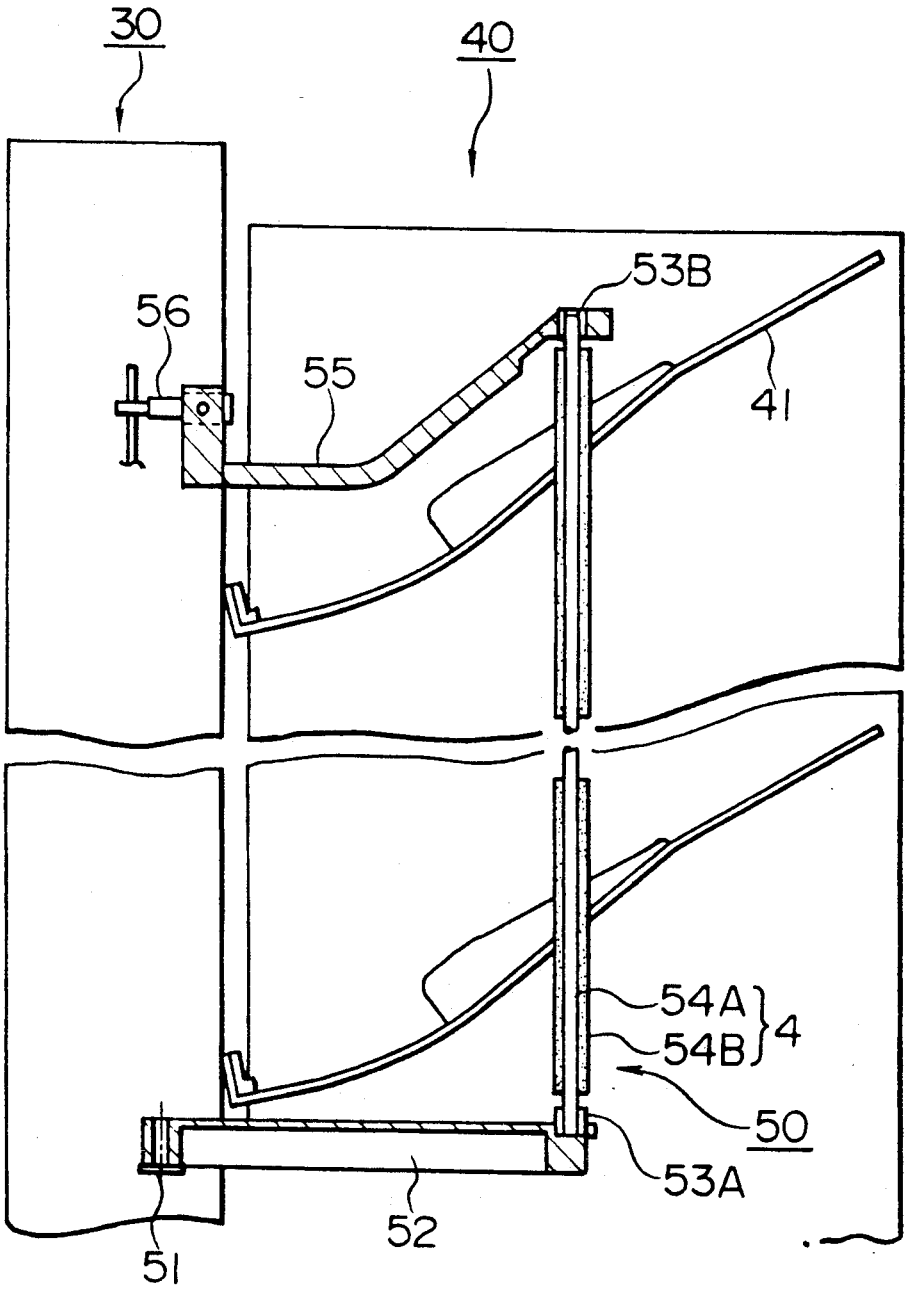
FIG. 5 is a front sectional view of the alignment device.
Figure 6:
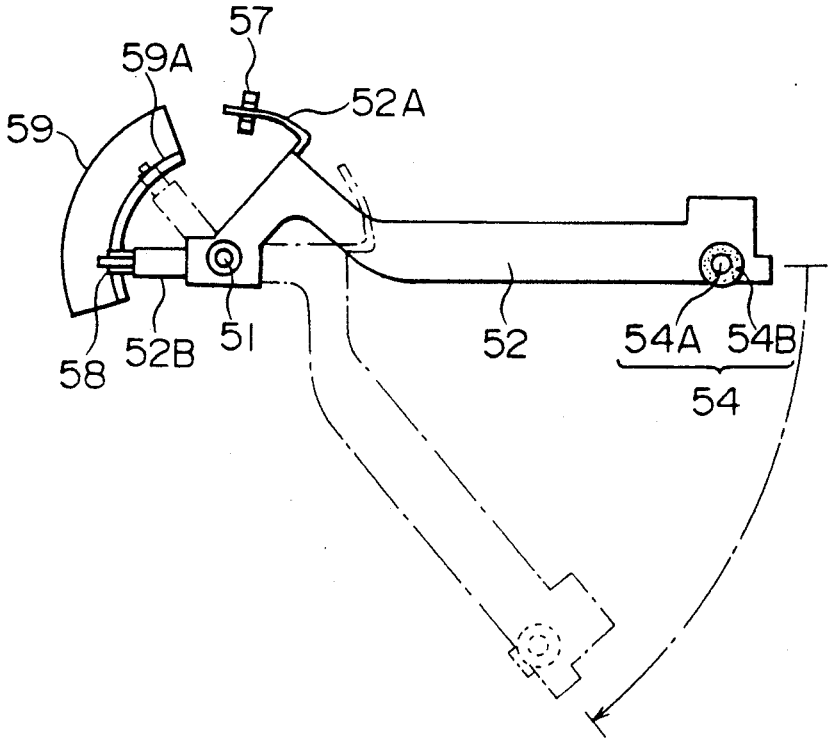
FIG. 6 is a plan view of the alignment device.

On the other hand, an alignment member 50 which aligns the side of sheet P ejected from the main body 1 of a copying machine onto the bin 41, is provided in one portion of the fixed frame of the upward conveyance section 30. FIG. 5 is a sectional front view of the alignment device 50, and FIG. 6 is a plan view of the alignment member 50.

In the alignment member 50, a lower arm 52 is engaged with a lower shaft 51 mounted on the lower portion of the aforementioned frame so that it can be freely oscillated by a pulse motor (not illustrated in the drawing). A lower shaft end of a core bar 54A of an alignment rod 54 is supported by an aligning bearing 53A at the tip of the lower arm 52. The circumference of the core bar 54A of the alignment rod 54 is covered with a resilient member 54B made of a foam material such as sponge, and the resilient member 54B is contacted with the side of sheet P so that the side of sheet P can be aligned.

An upper shaft end of the core bar 54A of the aforementioned alignment rod 54 is supported by an aligning bearing 53B mounted on the shaft end of an upper arm 55. The upper arm 55 is engaged with an upper shaft 56 mounted on the upper portion of the aforementioned frame so that the upper arm 55 can be rotated.

An arc-shaped curved portion 52A is protruded from a portion of the aforementioned lower arm 52, and when an optical path of a photo-interrupter 57 is interrupted, the home position of the lower arm is detected.

The oscillating angle of the aforementioned lower arm 52 can be changed when the setting pulse number of the aforementioned pulse motor is changed so that sheet P can be aligned in accordance with the size of sheet P.

A roller 58 is rotatably engaged with protruded shaft portion 52B which is protruded from a portion of the aforementioned lower arm 52. The roller 58 is contacted in a slidable manner with a groove cam portion 59A of a cam member 59 which is fixed to the aforementioned frame. Accordingly, when the lower arm 52 is oscillated around the lower shaft 51, the lower arm 52 is also oscillated in the direction of the shaft. When the aforementioned oscillation is conducted, sheets P put on the bin 41 are aligned by the oscillation of the alignment rod 54, and the side of the sheet can be pressed downward so that the sheets can be aligned.

The aforementioned alignment rod 54 moves along a locus which is shown by dashed lines in FIG. 4. On the other hand, in order to insert sheets on the bin 41 into a stapling member, the bin 41 is oscillated as shown by dashed lines in FIG. 5. Since the bin 41 is moved forward and backward, a large curved opening portion 41C is formed in the bin 41 as shown in the drawing so that the alignment rod 54 can not interfere with the bin 41. The numeral 46 is a reinforcing member to reinforce the opening portion 41C of the bin 41 in order to prevent deformation of the bin 41 caused by the opening portion 41C. This reinforcing member is fixed to the side of the bin 41 by screws, and at the same time engaged with a groove of the bin 41 into which the aforementioned slide member 44 is inserted, in order to prevent the slide member 44 from getting out.

Figure 7:
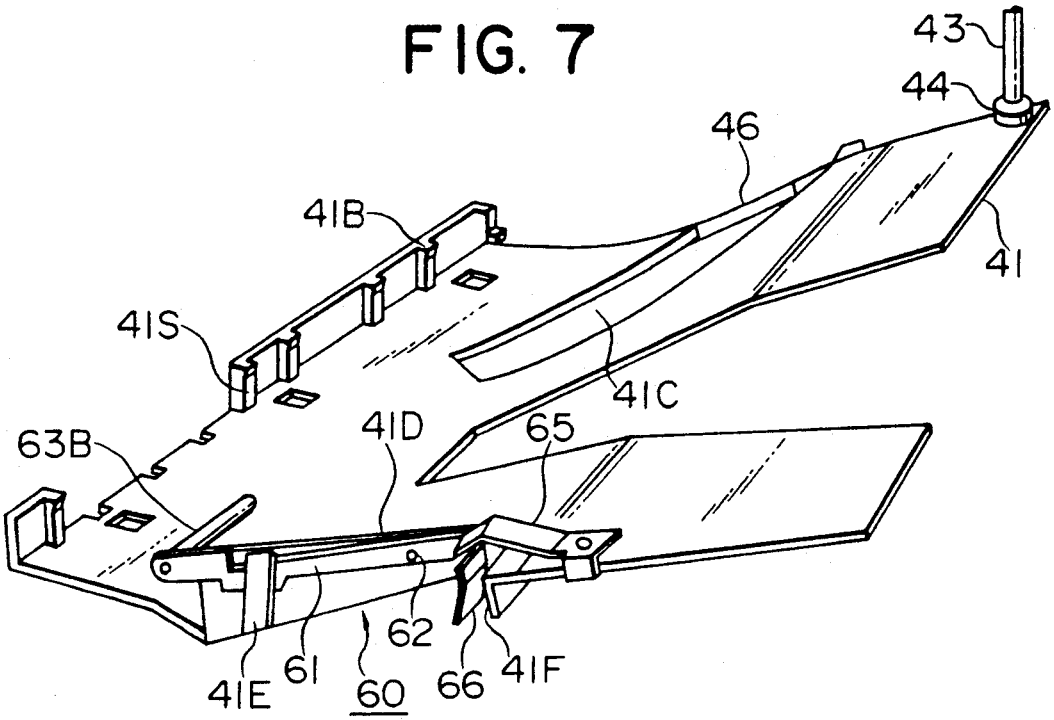
FIG. 7 is a perspective view of a bin equipped with a sheet-holding device.

A vertical stopper wall 41D is integrally provided on the side of the aforementioned bin 41. Sheet-holding device 60 is mounted on the outer side of the aforementioned stopper wall 41D. FIG. 7 is a perspective view of the bin 41 to which the sheet-holding device 60 is provided. Lever 61 is supported by shaft 62 mounted on the outer side surface of the stopper wall 41D in such a manner that the lever 61 can be freely oscillated. The numeral 41E is a guide portion to guide the lever 61 in a slidable manner. Long and slender shaft 63A is mounted on the tip of the lever 61, and a pipe-shaped member 63B is provided around the shaft 63A with a play. The other end of the aforementioned lever 61 is resiliently pressed by leaf spring 65. Leaf spring 66 is supported and fixed in the manner of a cantilever at a bending portion located under a position where the lever 61 is pushed by the spring. The leaf spring 66 is pushed by a roller 72 mounted on the tip of the second arm 71B of a bin oscillating device 70.

Figure 8:
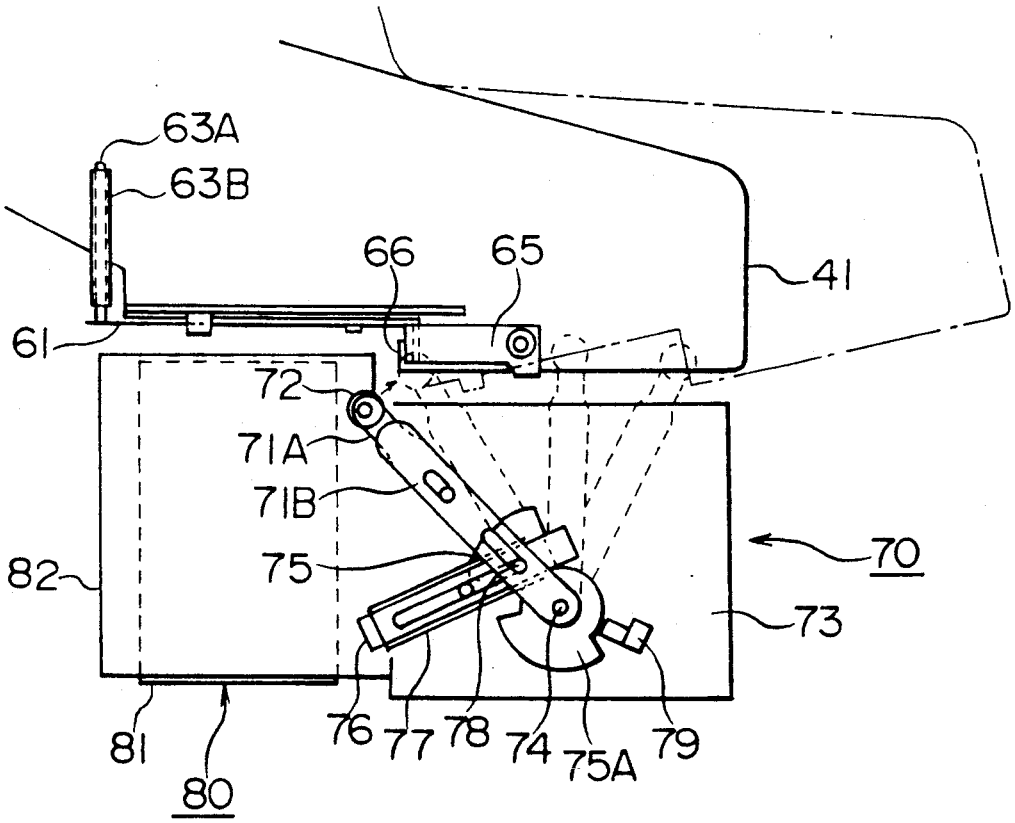
FIG. 8 is a plan view of a bin-swinging device.

FIG. 8 is a plan view of the bin oscillating device 70 which oscillates the aforementioned bin 41 and at the same time activates the aforementioned sheet holding device 60.

The bin oscillating device 70 is mounted on base plate 73. The first arm 71A is coaxially provided to a rotating shaft 74 which is driven by a motor and reduction gear train not illustrated in the drawing. The second arm 71B having elongated holes is provided to the first arm 71A in such a manner that it can be slid in the radial direction being pushed by a spring. Rubber coated roller 72 is mounted on the tip of the second arm 71B.

Cam plate 75 is provided to the aforementioned rotating shaft 74, and the cam plate 75 is composed of a U-shaped groove and an arc portion having the same radius.

On the other hand, a follower shaft 78 is supported being pushed by a spring, wherein the follower shaft 78 penetrates through a long groove portion of a moving member 77 which slides straight on guide member 76 mounted on a portion of the base plate 73, the aforementioned first arm 71A, and the second arm 71B.

Segmental shielding plate 75A is integrally provided at the other end of the aforementioned cam plate 75, so that a photo-interrupter 79 is turned on and off.

When the aforementioned first arm 71A is rotated clockwise as shown by a broken line in FIG. 8, the follower shaft 78 moves the groove portion of the moving member 77 and at the same time moves the groove of the cam plate 75 to the outside. After the follower shaft 78 leaves the grooves, it slides on the curved surface of the arc portion having an equal radius. Before the aforementioned operation, the shielding plate 75A of the tail portion of the cam plate 75 interrupts the optical path of the photo-interrupter 79 so that the power source is turned off and the rotation of the motor is stopped. Consequently, even when there is an overrun after the motor has been stopped, the follower shaft 78 moves and stops on the arc portion having the equal radius of the cam plate 75, so that the first arm 71A maintains its stop position at a predetermined angle. Accordingly, the bin 41 stops at a predetermined position. The base plate 73 of the aforementioned bin oscillating device 70 is mounted on the common frame 82 together with the base plate 81 of the stapling device. The base plate 73 moves vertically on the frame of the aforementioned bin shift section 40, and stops at each bin 41. Then, a bundle of sheets stacked on the aforementioned oscillated bin 41 being held by the aforementioned sheet-holding device 63B, enter into a stapling clearance of the stapling device to be stapled.

After the stack of sheets has been stapled, the second arm 71 is oscillated back so that the bin 41 is returned to the original sheet position being pushed by a spring.

Next, the stapling operation conducted on the stack of sheets ejected into the bin 41, will be explained as follows.

The position of a document on the platen glass of the main body 1 of a copying machine, can be determined in two ways, one in which the document is set so that the center of the document can coincide with the center line of the copier, and the other in which the document is set so that one side of the document can coincide with a reference line.

Figure 9:
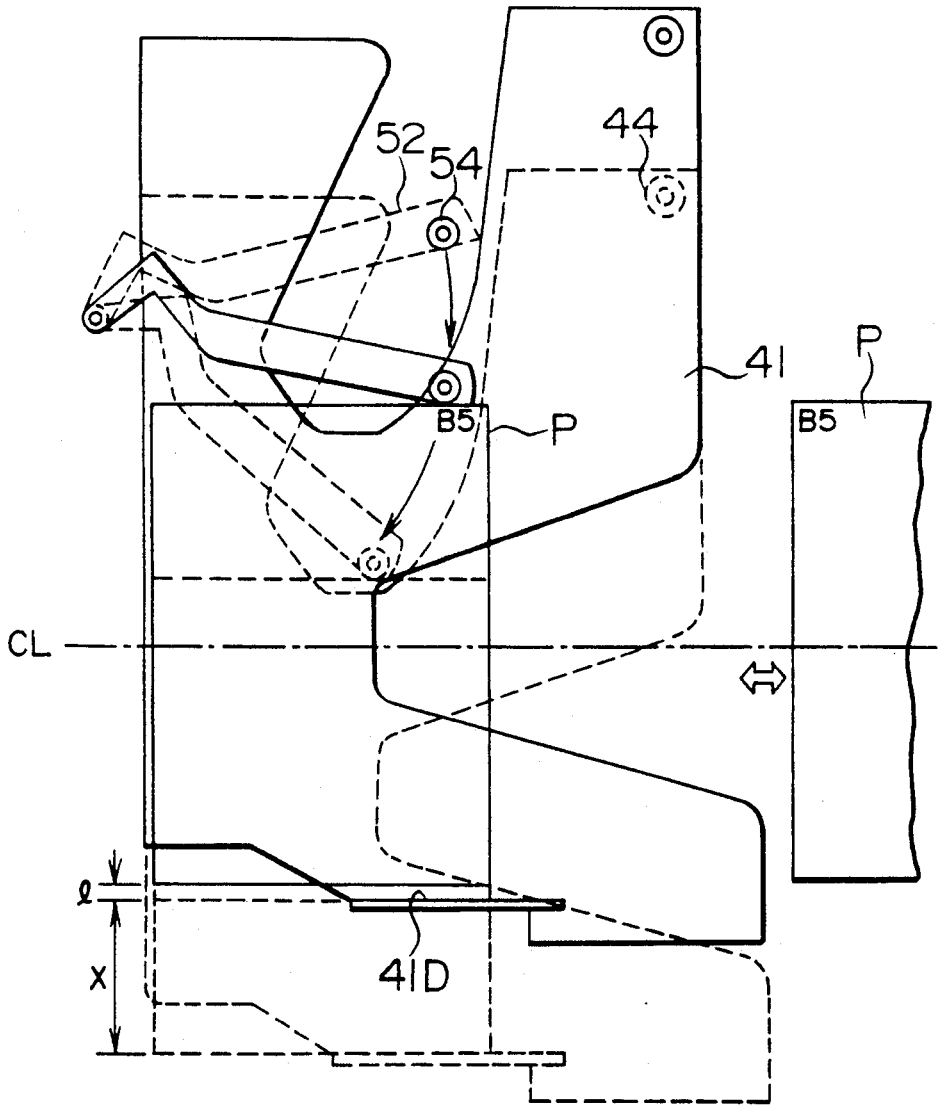
FIG. 9 is a plan view showing the straight movement of the bin.
Figure 10:
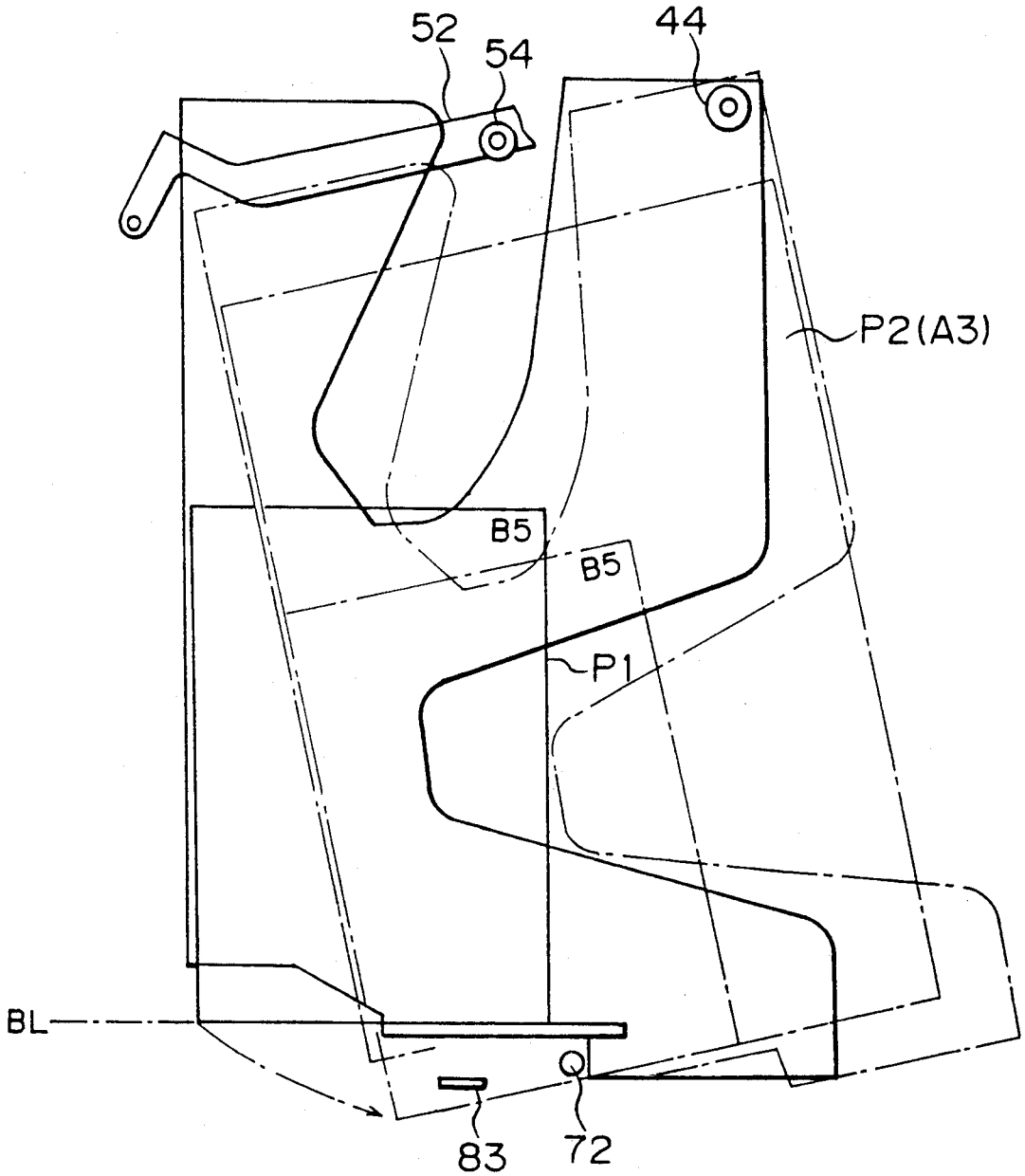
FIG. 10 is is a plan view showing swinging process for the bin.

Stapling operation for the stack of sheets P ejected through the center line CL will be explained below, referring to FIGS. 9 and 10.

(1) When the size of sheet P (a copy paper) ejected from the image forming apparatus 1 is set manually or automatically, the bin shift section 40 of the sorter is driven electrically, and when the bin has reached a predetermined position corresponding to the size of the aforementioned paper, the bin stops according to a signal sent from a position detecting sensor. Therefore, the bin is set in a waiting condition. The maximum movement distance x of bin shift section 40 is set to the value (e.g., 87.4 mm) that is a half of the difference between the maximum sheet size (e.g., 17 in.) and the minimum sheet size (e.g., B5 size, 257 mm). When the bin 41 is in the aforementioned waiting position, a stopper wall 41D of the bin 41 is located in a position separated from the side of sheet P entering into the bin, by the distance of l (for example, 10 mm).

(2) In the aforementioned condition, sheet P1 enters from the left in the drawing, and moves upward along the inclined surface of the bin 41. After that, sheet P1 slides down by its empty weight and bumps against a front stopper 41S to be stopped.

(3) After sheet P has been stopped, the alignment rod 54 is oscillated and pushes one side edge of sheet P to move it toward the viewer's side by the distance of l, so that the other side edge of sheet P can be contacted with the stopper wall 41D. This distance l is set to almost the same in the case of other sizes (for example, A4 size, B4 size and A3 size).

(4) Successively, the following sheets P are ejected, being switched by the branch guide 36, into the second bin 41 on the lower deck, and the alignment rod 54 is oscillated and presses the side edges of sheets P in the same way as the foregoing so that the sheets P may touch the stopper wall 41D to be aligned.

(5) In the same way as the foregoing, sheets are successively led into bins 41 in quantity corresponding to the number of sets of copies to be stacked thereon.

(6) The detection by means of a counting means of CPU control that sheets P in a quantity set in advance have been ejected from the image forming apparatus and accepted in the uppermost bin 41, and the detection that an optical path of an optical detection means located between light emitting element LED provided on the top of bin shift section 40 and light-receiving element PTr provided at the lower portion thereof is opened after the trailing edge of the last sheet P to be accepted in the uppermost bin 41 mentioned above has passed the optical path, mean that ejection of sheets into the bin 41 has been completed.

(7) Immediately after the detection of completion of sheets ejection made in the same way as the foregoing into the second bin 41, the aforementioned uppermost bin 41 is oscillated by the aforesaid bin oscillating device 70.

(8) FIG. 8 is a plan view showing bin oscillating process that indicates stapling operation. When stapling signals are inputted in the bin shift section 40 that is suspended in operation as described above, the aforementioned bin oscillating device 70 is driven first, arm 71B is oscillated and roller 72 located at the tip thereof presses leaf spring 66 located at the bottom of the aforesaid sheet-holding device 60 and further oscillates lever 61 counterclockwise around shaft 62 against the urging force of the leaf spring 65, thus sheet-holding member 63B presses the upper surface of a sheet on the bin 41.

(9) Successively, the roller 72 located at the tip of arm 71B is oscillated around the slide member 44, and oscillates the bin 41 while pressing the sheet on the bin 41 (approximately 12°).

(10) When follower shaft 78 of bin oscillating device 70 rises up to a circular curved surface of cam plate 75 where the radius of the cam continues to be the greatest, photosensor 79 detects the position and the operation is stopped, or even when the cam continues rotating slightly, the position of roller 72 remains unchanged and the oscillation of the bin 41 is stopped.

(11) At this stop position, the leading edge corner of the stack of sheets is inserted into a clearance for stapling formed in the stapling device 80, and then the stapling device 80 is driven so that the stack of sheets can be stapled with staple 83.

(12) After the stapling operation has been completed, the arm 71 is returned, so that the bin 41 is pushed by the spring and returned to the original position, and at the same time the sheet-holding member 62B is separated from the surface of the bundle of papers. Therefore, the bundle of papers can be taken out of the bin 41.

(13) After the stack of sheets held in the uppermost bin 41 has been stapled, the common frame 82 in which the stapling device 80 and the bin oscillating device 70 are integrally provided, is lowered by a drive unit, and the bin 41 which is located under the uppermost bin is oscillated so that the same stapling operation can be conducted. During the aforementioned operation, a sheet ejecting operation is conducted in the bin 41 located in the further lower position.

Incidentally, in the above description, the start of oscillation and stapling operation for the uppermost bin are conducted after the ejection of sheets into the second bin has been completed. However, after the ejection of sheets into the third bin, the start of oscillation and stapling operation for the uppermost bin which is upper by two steps than the third bin may also be conducted.

(14) After all the stacks of sheets have been stapled, the bin shift section 40 returns to its home position and prepares for the next operation. This home position may either be one where bin shift section 40 has advanced to the full or be one where bin shift section 40 has withdrawn to the full.

According to the invention, as stated above, the stapling device is driven to move up and down, and a bin in which sheets are accepted and stacked is oscillated for stapling and the oscillation of the bin for stapling is started synchronizing with the completion of ejection of the last sheet into the next bin. Therefore, the time required for stapling may be shortened, and especially, the first bundle of stapled sheets can be taken out quickly, resulting in the reduced waiting time.

The second example of the invention will be explained as follows. In the example, unless the aforementioned bundle of stapled sheets returns to the original position, the next stapling operation can not be started. Therefore, troubles such as the accidental touch of the stapler to a bin or sheet jamming are not generated.

Figure 11:
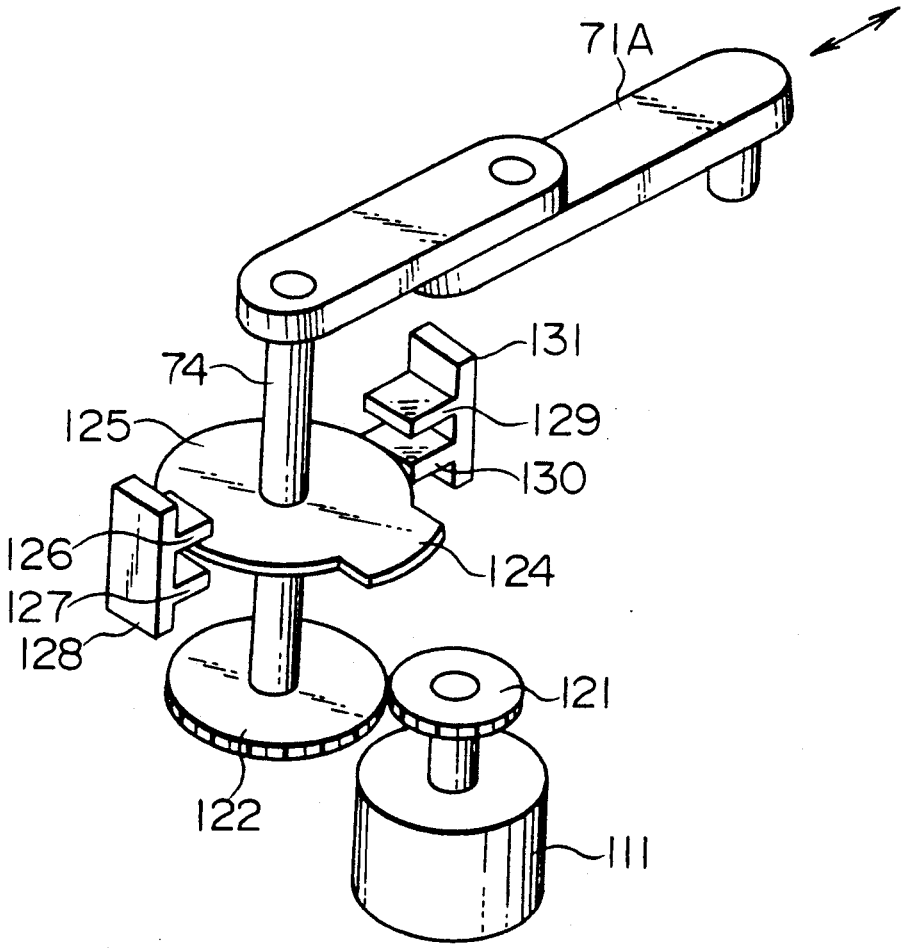
FIG. 11 is an illustration of the mechanism for detecting a rotated position of a bin in the second example of the invention.

The second example of the invention will be explained as follows. FIG. 11 is an illustration of the structure for detecting the bin oscillated position in the second example, FIG. 12 is a block diagram for bin oscillation control, and FIG. 13 is a flowchart of its control.

In FIG. 11, gear 122 engaging with output gear 121 of bin oscillating motor 111 is affixed on shaft 74 on which elastic arm 71A is fixed, and on the shaft 74, there is further affixed similarly the light-shielding plate 125 having thereon light-shielding protrusion 124. On the peripheral surface where the light-shielding plate 125 rotates, there is provided stapling position sensor 128 composed of a photointerrupter consisting of light-emitting unit 126 and light-receiving unit 127. On the location deviated by predetermined angles from the sensor 128, there is provided sheet (bin) regular position sensor 131 composed of a similar photointerrupter consisting of light-emitting unit 129 and light-receiving unit 130.

Figure 12:
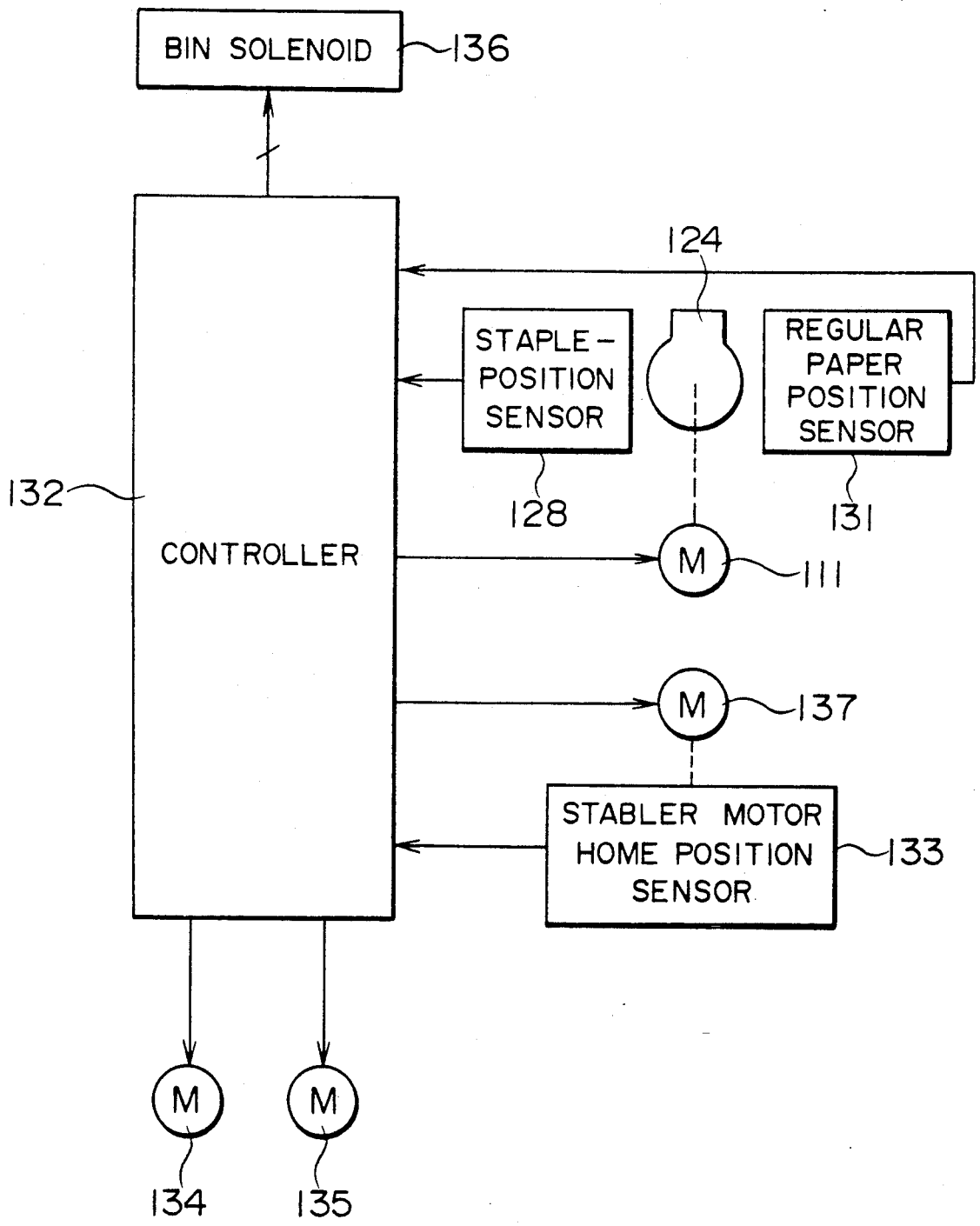
FIG. 12 is a circuit diagram of a stapling control circuit in the example mentioned above.

In FIG. 12, control board 132 takes in signals and others detected by staple motor home position (HP) sensor 133, staple position sensor 128 and sheet (bin) regular position sensor 131, and it outputs driving signals, depending on a built-in predetermined program, to conveyance motor 134 for conveying sheets, sheets aligning motor 135 that aligns a stack of sheets on the bin, solenoid 136 for driving a bin, stapler motor 137 for driving the stapler, and bin-oscillating motor 111.

Now, in the process of stapling in the present example, the bin-oscillating motor 111 is rotated first so that the elastic arm 71A may be rotated as shown on the flowchart in FIG. 13-*a*, and when the staple position sensor 128 detects the light-shielding protrusion 124 of the light-shielding plate 125, the rotation of the bin-oscillating motor 111 is stopped. After that, when the stack of sheets on the bin is detected by an unillustrated sensor, the staple motor 137 is driven to staple the stack of sheets, and when the staple motor 137 is detected by the home position sensor 133, the staple motor 137 is suspended. After that, the bin oscillating motor 111 is reversed and when the light-shielding protrusion 124 of the light-shielding plate 125 is detected by the sheet (bin) regular position sensor 131, the bin oscillating motor 111 is suspended. After this, the stapler is moved for the stapling for the next bin.

According to the present example, after the detection that the stapler has completed its stapling operation and the bin on which the sheets are stacked has returned to its regular position, the stapler starts moving for the following stapling operation, thereby preventing surely the accidental touch of the stapler to the bin and sheet jamming, enabling the quick stapling to be realized.

FIG. 13-*b* is a control flowchart showing a variation of the present example In the process of stapling in the variation of the present example, the bin-oscillating motor 11 is rotated first so that the elastic arm 12 may be rotated as shown on the flowchart in FIG. 13-*a*, and when the staple position sensor 28 detects the light-shielding protrusion 24 of the light-shielding plate 25, the rotation of the bin-oscillating motor 11 is stopped. After that, when the stack of sheets 15 on the bin 8 is detected by an unillustrated sensor, the staple motor 37 is driven to staple the stack of sheets 15 after a certain period of time T (e.g., 1 sec) has passed, and when the staple motor 37 is detected by the home position sensor 33, the staple motor 37 is suspended. After that, the bin-oscillating motor 11 is reversed and when the light-shielding protrusion 24 of the light-shielding plate 25 is detected by the sheet (bin) regular position sensor 31, the bin oscillating motor 11 is suspended. After this, the stapler 9 is moved for the stapling for the next bin 8.

From the foregoing, stapling is conducted after a certain period of time from the moment when the stack of sheets has arrived at the stapling position in the variation of the present example. Therefore, stapling is conducted after the moved sheets in a stack are stabled, resulting in sure stabling free from uneven alignment.

The third example of the invention will be explained as follows, referring to the drawings.

Figure 14:
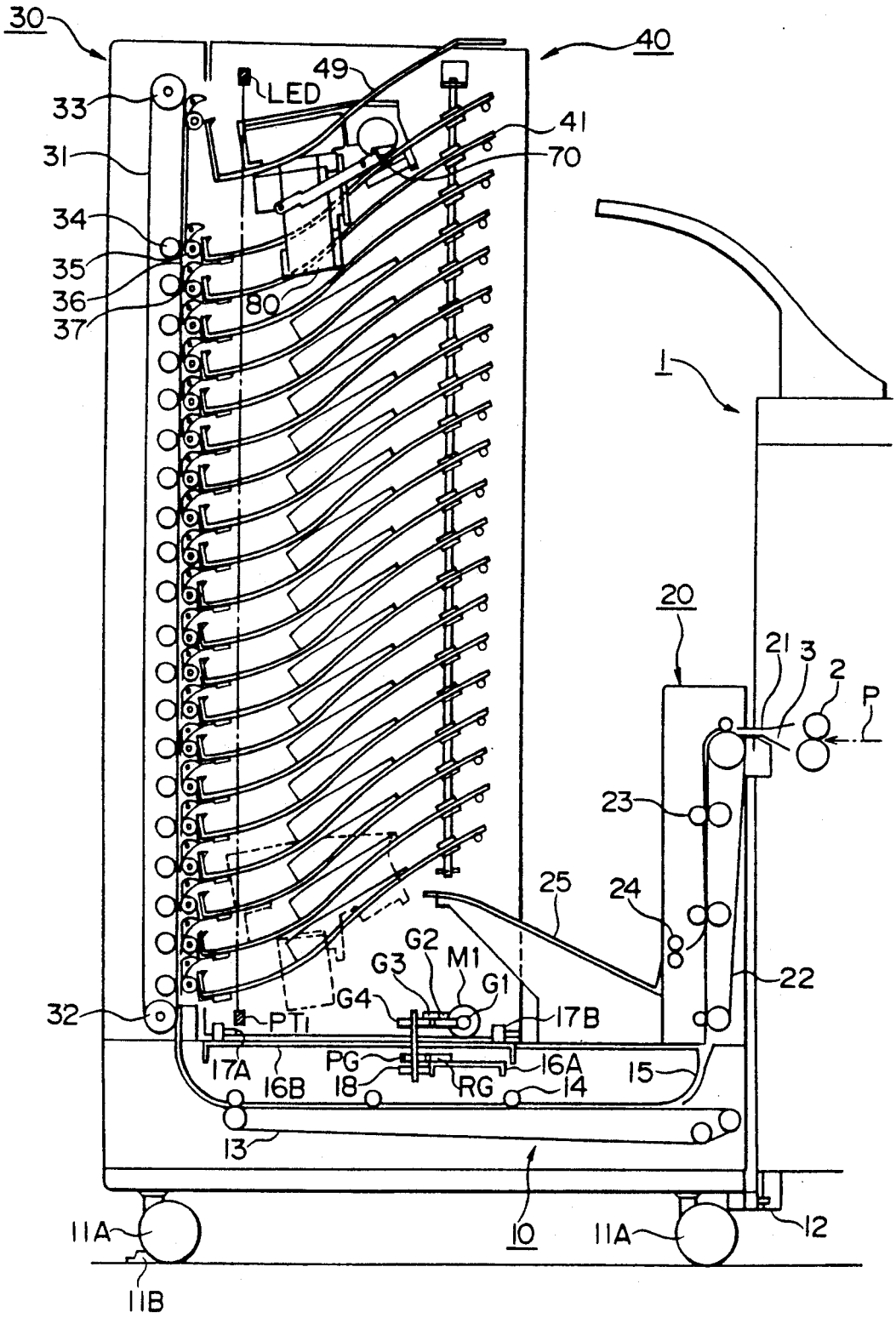

FIG. 14 is a schematic diagram of a sorter connected to the main body 1 of an image forming apparatus (e.g., a copying machine). The sorter of the invention comprises base frame 10, downward conveyance section 20, upward conveyance section 30 and bin shift section 40. In the present example, structural items identical to those in Example 1 are given the same numbers as those in Example 1 so that overlapped explanations may be avoided.

On the aforesaid base frame (intermediate conveyance section) 10, there is affixed stay member 16A in the direction perpendicular to a plane of FIG. 14. Rack gear RG is fixed on the upper side of the stay member 16A.

In the main body of bin shift section 40, there are provided rollers 17A and 17B for the movement of the main body, and these rollers 17A and 17B roll on rail 16B provided on the aforementioned base frame 10 to enable the main body of the bin shift section 40 to move in the direction perpendicular to a plane of the figure.

Motor M1 is provided inside the frame of the aforementioned bin shift section 40, and rotates pinion gear PG through worm gears G1 and reduction gear train G2, G3 and G4. Since pinion gear PG meshes with rack gear RG fixed to the aforementioned stay 16A, the frame of the bin shift section 40 is moved in a direction perpendicular to the plane of the drawing when Motor M1 is rotated. The numeral 18 is a rotatable roller mounted on the shaft of the aforementioned pinion gear PG. The roller 18 comes into contact with the aforementioned stay 16A so as to guide.

Figure 15:
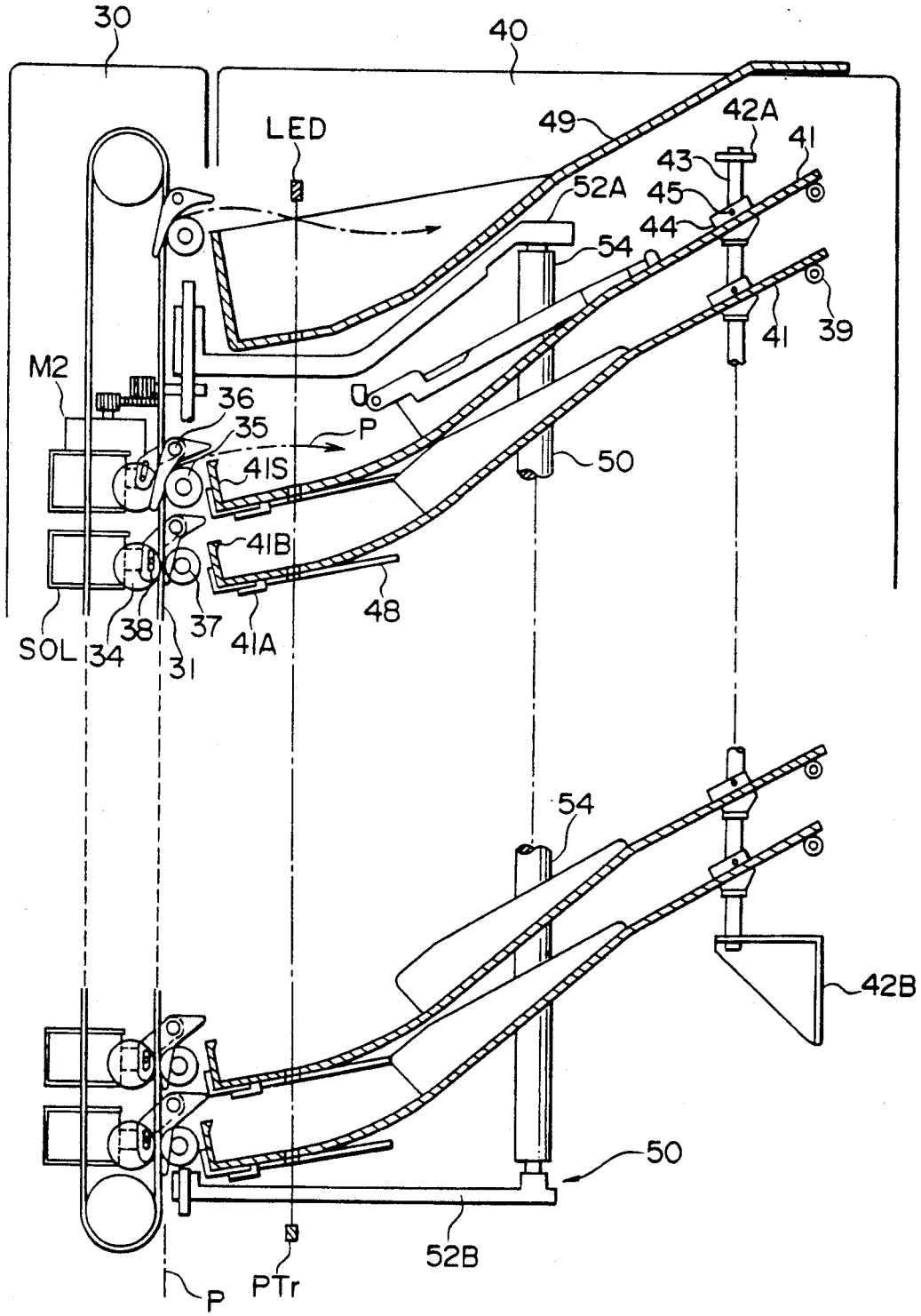

FIG. 15 shows sectional views of the upper portion and the lower portion of the sorter.

Sheet P (shown with dashed lines in the figure) transported at high speed into the upward conveyance section 30 of the sorter ascends while being sandwiched between conveyance belt 31 and conveyance roller 35, changes its direction to the right (shown with dashed lines in the figure) due to the branch guide 36 driven by a solenoid and swung clockwise, passes through the upper portion of stopper wall 41S erected on the aforementioned bin 41, goes up along a slanting surface of the bin 41, then changes its direction for going down after its trailing edge has passed through the upper portion of the aforementioned stopper wall 41S, slides down along the surface of the bin 41 due to its empty weight, and finally stops with its trailing edge touching the stopper wall 41S.

Figure 16:
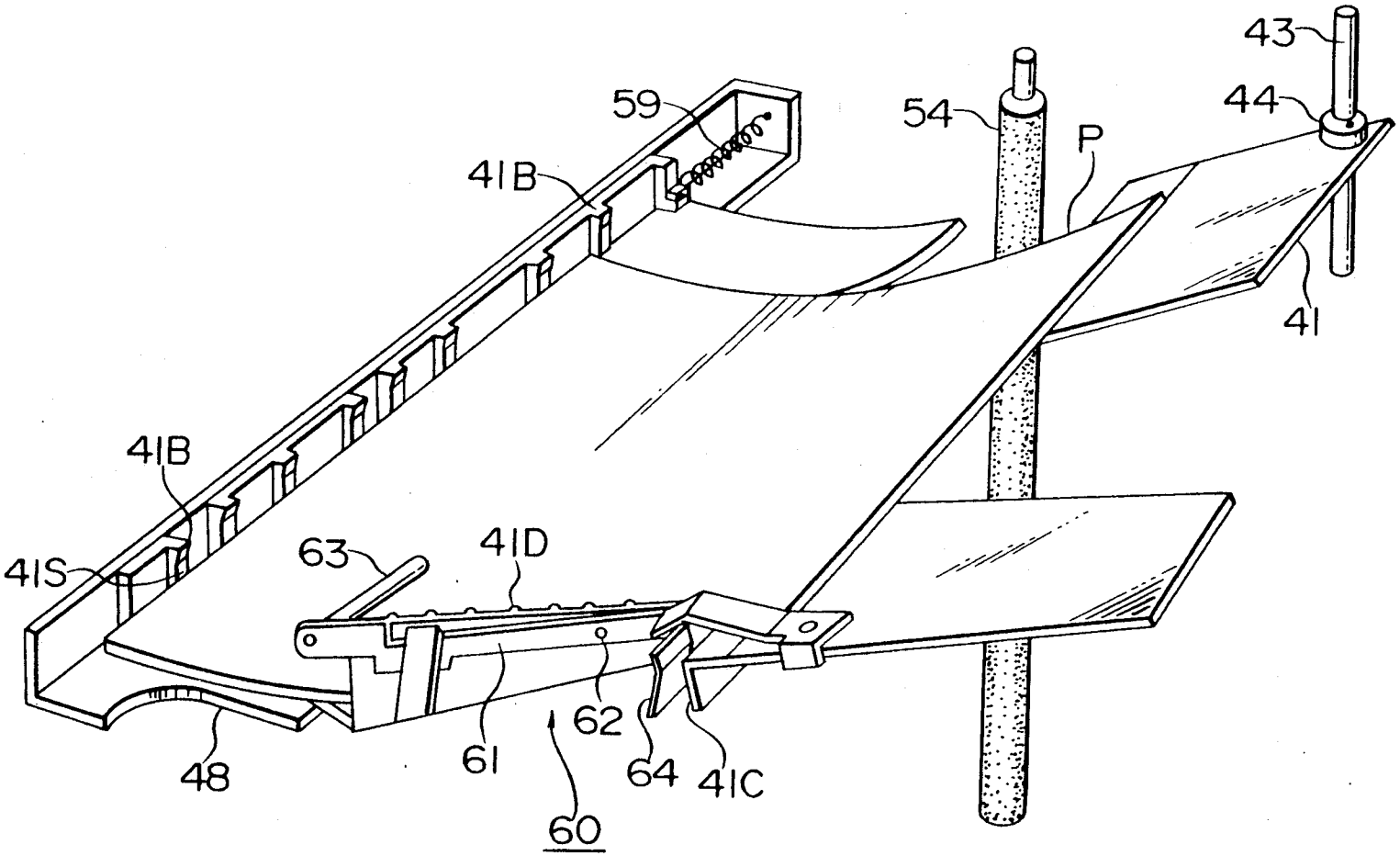
Figure 17:
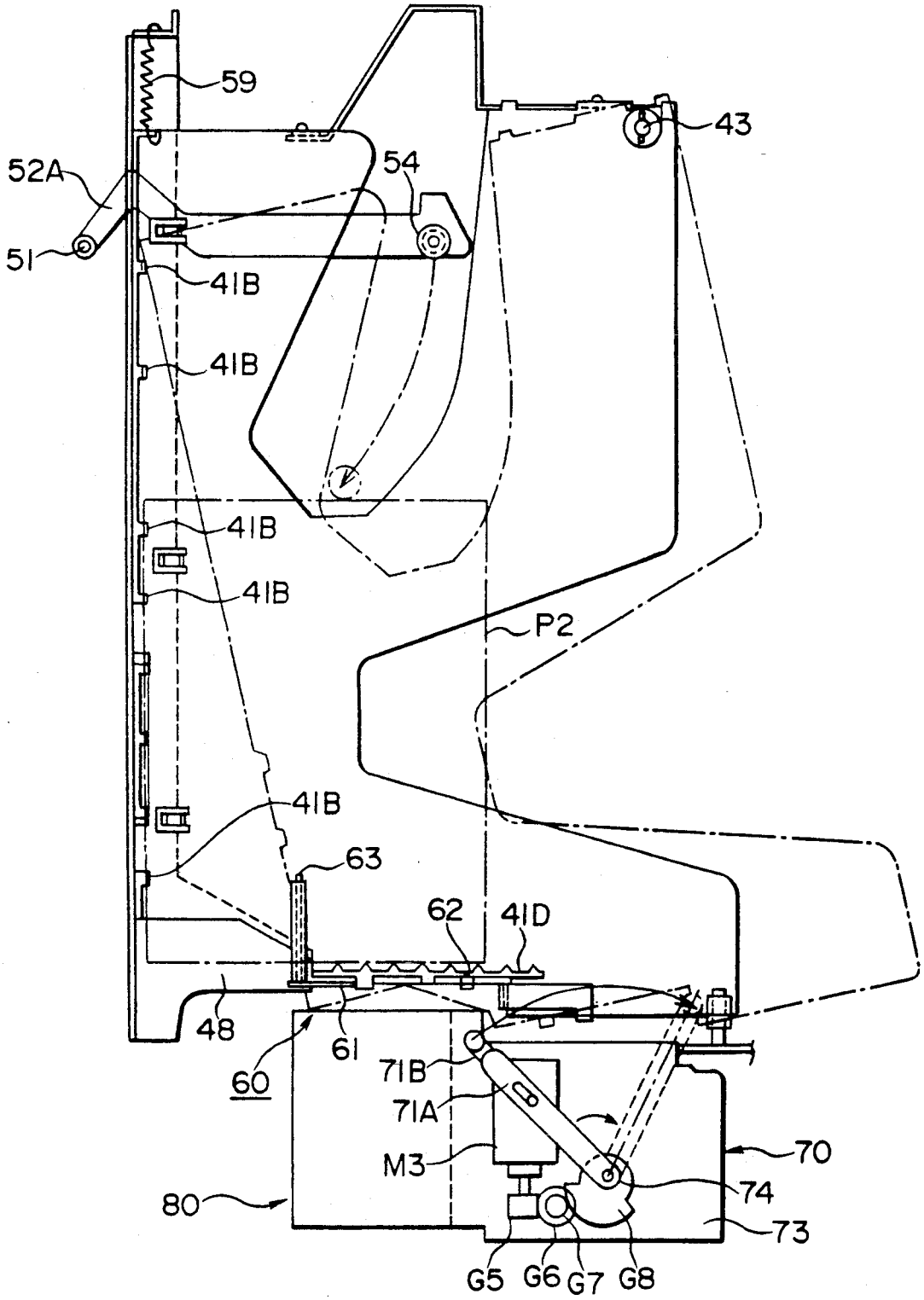

FIG. 16 is a perspective view of bin 41 and FIG. 17 is a plan view of a bin and a bin oscillating device.

In the sorter provided with the stapling device, in order to insert sheets P stacked on the bin 41 into the stapling device, all the bins 41 are advanced or withdrawn by motor M1 correspondingly to the sheet size as shown in FIG. 14. Further, each bin 41 is oscillated around the fixed shaft 43 by bin oscillating device 70 which will be described later.

In a portion of the fixed frame of the upward conveyance section 30, is provided the alignment device 50 which aligns the side edges of sheet P ejected onto the bin 41 from the image forming apparatus 1.

The alignment device 50 is operated as follows. The rotating shaft 51 is vertically supported by the upper and lower portion of the fixed frame, and rotated by pulse motor M2 through a gear transmitting system. The upper arm 52A and lower arm 52B are engaged with the rotating shaft 51 in such a manner that they can be freely rotated. The upper and lower portion of the alignment rod 54 are supported by the upper arm 52A and lower arm 52B through the aligning bearings 53 so that the alignment rod 54 can be oscillated.

The resilient member coated on the outer peripheral surface of the alignment rod 54 is contacted with the side edge of sheet P with light pressure so that sheet P can be pressed against the stopper wall 41D provided on the side of the bin 41 in order to align the side of sheet P.

The oscillating angles of the aforementioned upper arm 52A and lower arm 52B are changed according to the pulse number of the aforementioned pulse motor M2 so that an alignment operation can be conducted correspondingly to the size of ejected sheet P.

The sheet-holding device 60 is provided on the outer side surface of the aforementioned stopper wall 41D. The lever 61 is rotatably supported by the shaft 62 mounted on the outer side surface of the stopper wall 41D. The sheet-holding member 63 is provided on one end portion of the lever 61. The other end of the aforementioned lever 61 is pressed by the roller 72 located at the tip of the arm 71 of the bin oscillating device 70. Since the lever 61 is pressed in the aforementioned manner, the lever 61 is oscillated so that the upper surface of sheet P placed on the bin 41 is pressed. The sheet-holding operation is conducted in the manner described above.

The bin oscillating device 70 is fixed on base plate 73. Reversible motor M3 fixed on the base plate 73 rotates clockwise in the figure the sector gear G8 and rotary shaft 74 that is united solidly to the sector gear through a power transmission system including worm gear G5 and intermediate gears G6 and G7.

The aforementioned rotary shaft 74 is equipped with the first arm 71A on a coaxial basis. Against the first arm 71A, the second arm 71B having thereon an elongated hole is urged by means of a spring so that the second arm may move freely in the radial direction. At the tip of the second arm 71B, there is rotatably provided roller 72 that is covered with rubber.

When the aforementioned first arm 71A is driven to rotate to the right as shown with broken lines in FIG. 17, the roller 72 provided at the tip of the second arm 71B presses stopper surface 41C of the bin 41 through leaf spring 64 of sheet holding device 60 to cause the bin 41 to oscillate around the stationary shaft 43. Upon discontinuation of driving the first arm 71A, the bin 41 stops at a predetermined position where stapling can be done.

The base plate 73 of the aforementioned bin oscillating device 70 is mounted on the common frame together with the base plate 81 of the stapling device 80, and is moved up and down on a frame of the aforementioned bin shift section 40 and is stopped at each bin, so that sheets stacked on the aforementioned oscillated bin 41, while being held by the aforementioned sheet-holding member 63, can be entered into a clearance formed in the stapler device 80, and then a staple is driven into the stack of sheets.

After the staple has been driven, the arm 71B of the second arm is oscillated to be returned, and the bin 41 returns to its initial position being urged by the spring.

Figure 18:
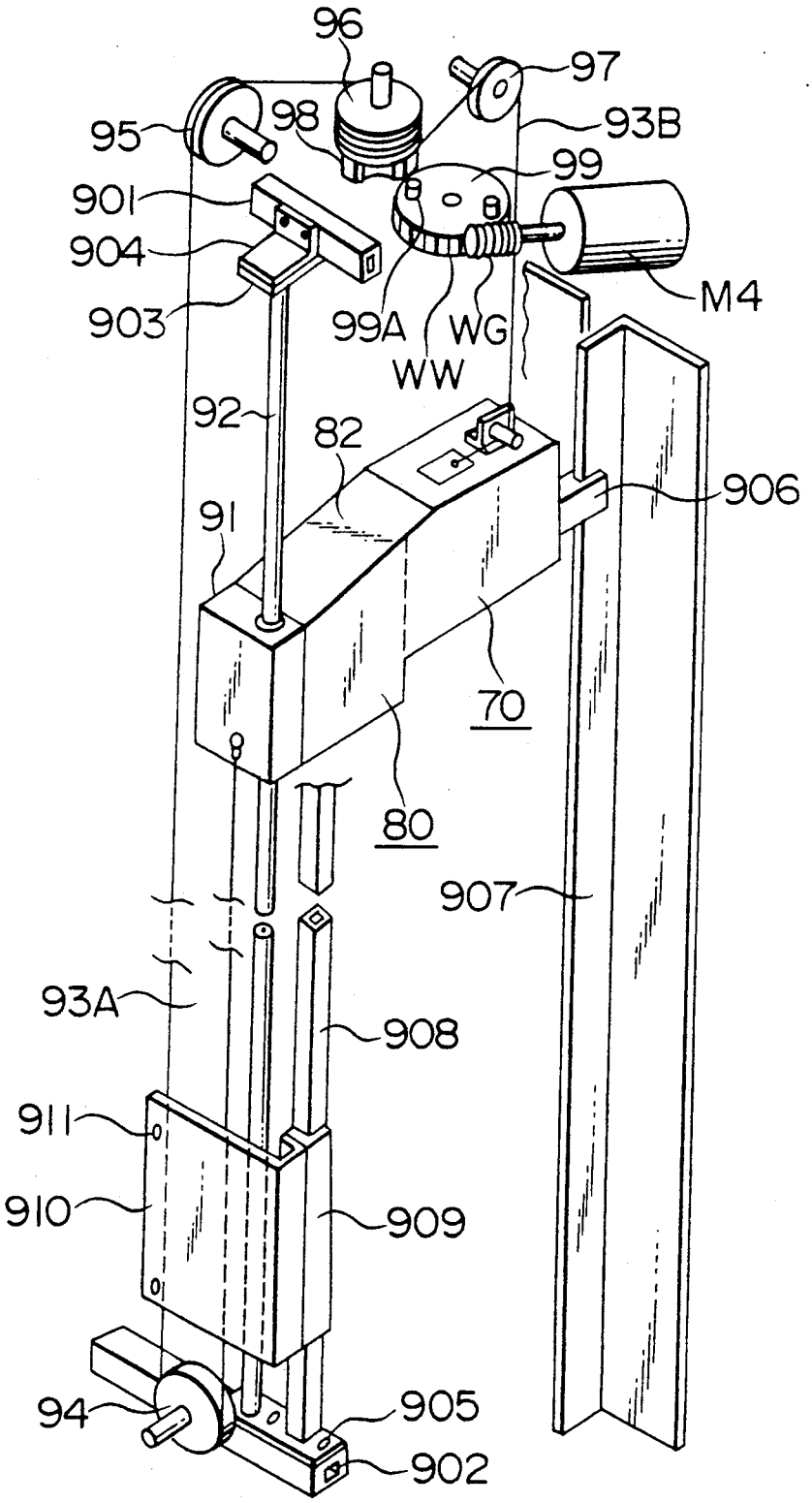

FIG. 18 is a perspective view of elevator device 90 for a unit body wherein the aforementioned bin oscillating device 70 and stapler device 80 are united solidly.

To one side of frame body 82 of the aforementioned unit body, is united guide holder 91 solidly. The guide holder 91 is capable of moving up and down while sliding on guide posts 92 each in the form of a hollow pipe. The guide posts 92 are respectively supported perpendicularly on frames 901 and 902 which are located at the upper portion and the lower portion respectively of the main body of bin shift section 40. Namely, the upper end portion of the guide post 92 is engaged with a hole portion provided on holding plate 903 that is fixed on upper frame 901, thus the upper end portion of the guide post 92 is positioned. Incidentally, the numeral 904 is positioned and fixed by means of holding plate 905 that prevents the guide post 92 from escaping upward.

On the opposite side of the guide post 92 of the aforementioned unit body, is fixed guide member 906 that is made of resin and is in a form of a fork. On the other hand, in the vertical direction of the sorter main body, there is formed sliding portion 907 that forms a part of framework of the sorter. The aforementioned unit body can move up and down vertically when a groove portion in a fork shape of the aforementioned guide member 906 slides on both surfaces of the aforementioned sliding portion 907.

In the vertical direction of the sorter main body, on the other hand, there is fixed hollow prism 908. On the hollow prism 908, slider 909 is capable of sliding in the vertical direction. To the slider 909, is united weight 910 solidly. On the left side of the weight 910 in the figure, the aforementioned wire 93A is fixed by clamping tool 911. The total weight of the weight 910 plus slider 909 is less than the weight of a unit body wherein the aforesaid bin oscillating device 70 and stapling device 80 are united, and it is actually set, considering the load of external force on the stapler device, to the value that is one fifth or one half of the weight of the stapling device, and it plays a role of a counterbalance.

When the aforementioned unit body is being drawn up by a driving means that is described later, the weight 910 affixed on the aforesaid wire 93A reduces, due to its empty weight, the load of weight on the unit body, together with the slider 909, so that the unit body may be drawn up by less torque. Even when the unit body is descending, the unit body can stop accurately, due to the aforementioned counterbalance effect, at the stop position for each bin requiring less torque for stapling.

Incidentally, the aforementioned unit body is on the type wherein the unit body is suspended by the wire 93B that is a driving means provided at the upper portion of the sorter. Therefore, when replenishing staples for the stapling device, even if external force is applied on the aforementioned unit body by an operator, the wire 93B is not slackened, due to the weight of the unit body having counterbalance, and thereby each of wires 93B and 93A is prevented from coming off each pulley.

At the upper portion of the aforesaid guide post 92, there is affixed a driving means that moves up and down the unit body wherein bin oscillating device 70 and stapling device 80 are united solidly on the sorter main body. In the vicinity of the lower portion of the aforesaid guide holder 91, there is fixed one end of the flexible wire 93A. The wire 93A is spread vertically between pulley 94 provided on the lower portion of bin shift section 40 and pulley 95 provided at the upper portion of bin shift section 40, and further is wound round broad pulley 96 for several turns, and its one end is fixed. On the aforesaid broad pulley 96, there is fixed one end of the other flexible wire 93B and the wire is wound round the broad pulley 96 for several turns and it descends through pulley 97 to be fixed on the upper portion of the other end of the aforementioned frame body 82 again. Therefore, wires 93A and 93B both ends of each being fixed on the stapling device 80 form a closed loop.

On the bottom surface of the aforementioned broad pulley 96, there is fixed four-piece type Geneva stop 98 on a coaxial basis to be capable of rotating together with the broad pulley. The four-piece type Geneva stop 98 is driven intermittently by two pins 99A of wheel 99. On the outer circumferential surface of the wheel 99, there are formed teeth (worm wheel) WW which engage with worm gear WG fixed on the rotary shaft of motor M4 to be rotated.

When the wheel 99 is rotated by 0.5 turns by motor M4 through worm gear WG and worm wheel WW, the four-piece type Geneva stop 98 and the broad pulley 96 make a quarter turns and stop. When an effective diameter of an external circumference of the broad pulley 96 is set to 160 mm, for example, the length of the wire 93 to be wound round the broad pulley 96 is 40 mm due to the aforementioned quarter turns, thus the aforementioned guide holder 91 is elevated or lowered by 40 mm. Therefore, when the vertical interval of the aforementioned bins 41 is set to 40 mm, the unit body wherein the bin oscillating device 70 and the stapling device 80 are united solidly is driven intermittently to stop at intervals of 40 mm, thus, a stack of sheets on each bin 41 are aligned and stapled.

An operation for stapling a stack of sheets ejected onto the bin 41 will be explained next.

There are two types of datum lines for positioning a document on a platen glass of image forming apparatus main body 1; one is a datum of a center line and the other is a datum of one side line for aligning.

Figure 19:
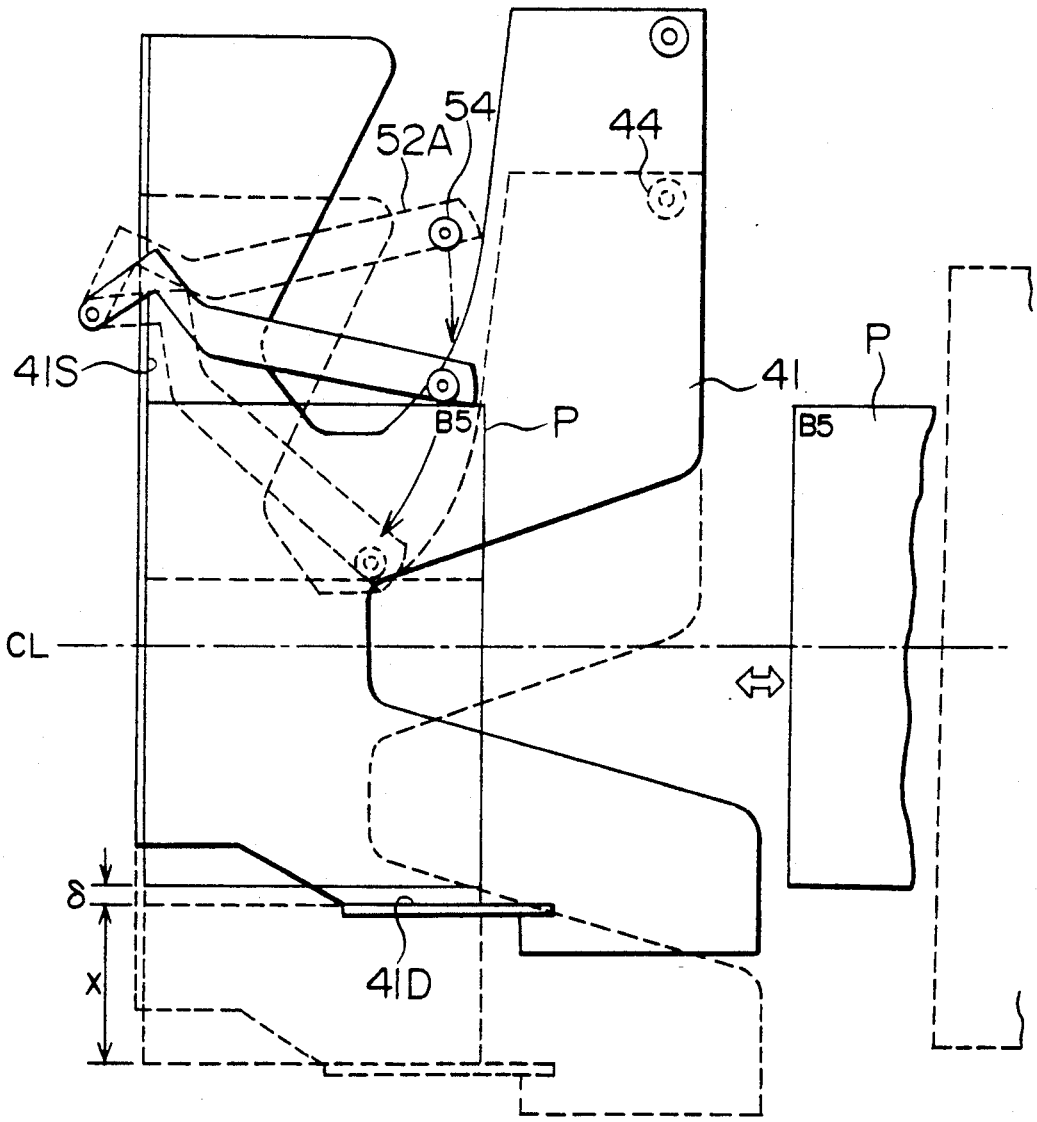

Stapling operation for a stack of sheets P ejected onto a bin on a center line CL basis will be explained as follows, referring to FIGS. 19 and 20.

(1) After the size of a sheet (transfer sheet) P ejected from image forming apparatus main body 1 is set manually or is automatically judged, bin shift section 40 of a sorter is motor-driven, and when the sheet arrives at the predetermined position corresponding to the size of the sheet, the sheet is stopped by the signals of a position detection sensor to be on a standby condition. The maximum movement distance of the bin shift section 40 is set to a half (e.g., 87.4 mm) of the difference between the sheet maximum size (e.g., 17 in.) and the sheet minimum size (e.g., B5 size, 257 mm). At this standby position, the stopper wall 41D for the bin 41 is at the position that is apart by δ (e.g., 10 mm) from the side edge of the sheet P that is entering.

(2) Under the condition mentioned above, the sheet P enters from the left in the figure and goes up along the slant of the uppermost bin 41. After that, the sheet slides down owing to its empty weight, then hits the stopper 41S located behind the bin 41 and stops there.

(3) After the sheets P stop, alignment bar 54 swings to press one side edge of the sheets P so that the sheets P may be moved to this side in the figure by the shifting amount of $\delta$ and the other side edge of the sheets P may touch the stopper wall 41D. This shifting amount $\delta$ is set to be almost the same even for other sheets having different sizes (e.g., A4 size, B4 size, A3 size).

(4) Successively, the following sheets P are ejected into the second bin 41 below the uppermost bin after being guided by branch guide 36, and the aforementioned alignment bar 54 swings to press the side edge of the sheets P in the same way so that the sheets P may touch the stopper wall 41D to be aligned.

(5) After the foregoing, sheets P are ejected successively into bins 41 in quantity corresponding to the number of documents and stacked thereon in the same way as the foregoing.

(6) The detection by means of a counting means controlled by CPU that sheets P in the set quantity have been accepted in the uppermost bin 41 and the detection that the passage of the trailing edge of the last sheet P to be accepted in the uppermost bin 41 has caused an optical path of an optical detection means to be on an open state, mean the completion of ejection of sheets P into the first bin 41.

(7) Immediately after the detection that ejection of sheets into the second bin 41 has been completed in the same way, or after the predetermined period of time from the detection, the aforementioned uppermost bin 41 is oscillated by the aforementioned bin oscillating device 70.

Figure 20:
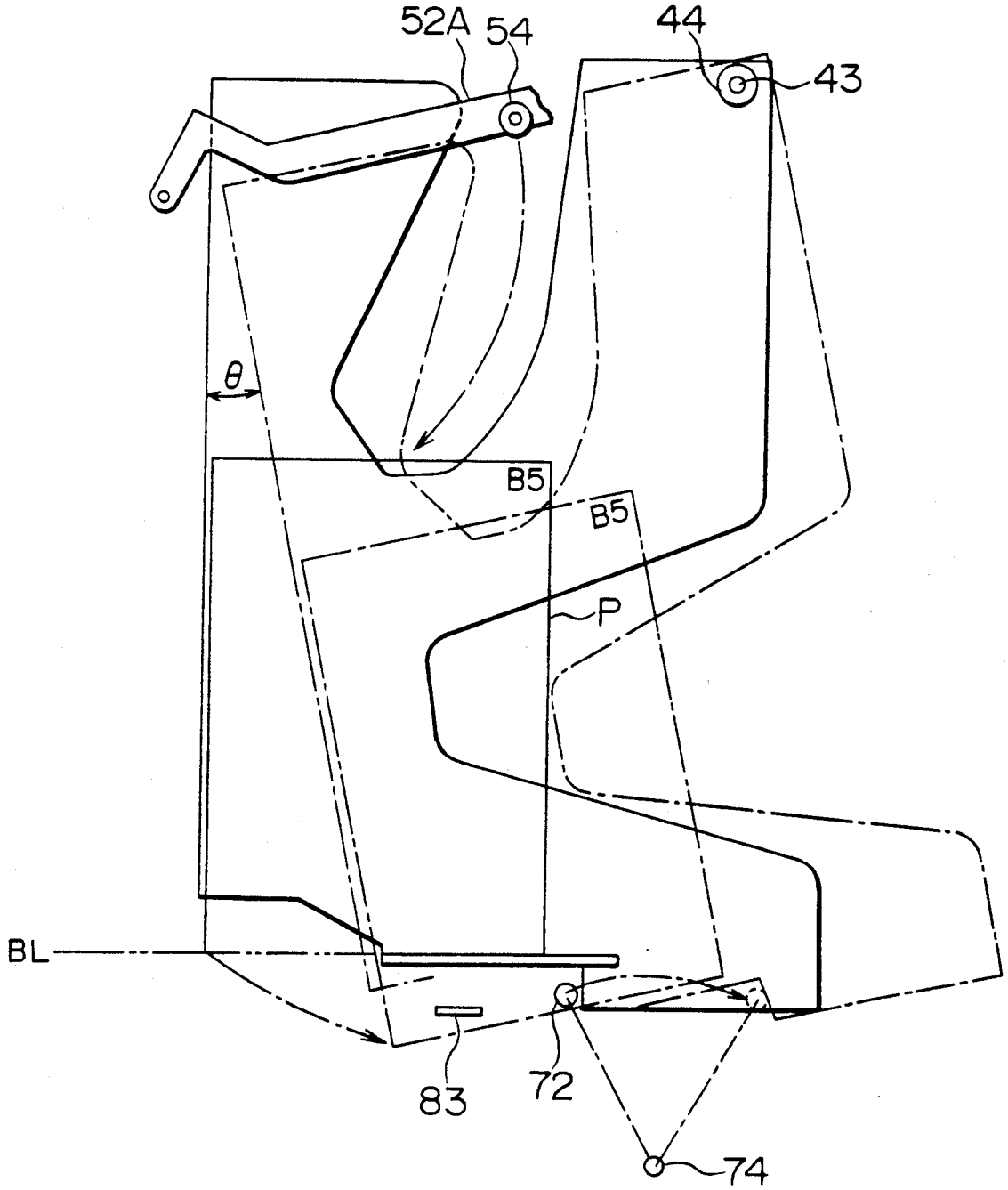

(8) FIG. 20 is a plan view showing the bin oscillating process that represents stapling operation. When staple signals are inputted into the aforementioned bin shift section 40 that is suspended, the aforementioned bin oscillating device 70 is driven first, and arm 71B oscillates and roller 72 located at the tip of the arm presses the leaf spring 64 located at the bottom of the aforementioned sheet-holding device 60, and it further swings the lever 61 counterclockwise around shaft 62 against the urging force of the leaf spring 65 located at the upper portion, thereby the sheet-holding member 63 presses with pressure the top surface of sheets stacked on the bin 41.

(9) Successively, the roller 72 located at the tip of the arm 71B further swings (e.g., by $\theta=12°$) around slide member 44 and causes the bin 41 to swing while pressing with pressure the sheets on the bin 41.

(10) When the bin oscillating device 70 is detected in terms of its position, it stops driving the bin 41, and the bin stops swinging.

(11) At this stop position of the bin, the corner portion on the trailing edge of a stack of sheets is inserted into the stapling clearance of stapling device 80 to be stapled with staple 83 that is forced in the sheets by the stapling device 80.

(12) After stapling, arm 71B is driven to return to its original position, and thereby bin 41 returns to its original position being urged by spring 59, and sheet-holding member 63 leaves the surface of the stack of sheets to enable the stack of sheets to be taken out of the bin 41.

(13) After the completion of stapling for a stack of sheets accepted in the uppermost bin 41 out of the aforesaid bins 41, the unit body wherein stapling device 80 and bin oscillating device 70 are united solidly is lowered by elevator device 90, and almost concurrently with the foregoing, the bin 41 directly under the uppermost bin is swung and thus stapling operation is performed similarly to the foregoing. During this period, sheets are ejected into bin 41 that is right under or is lower by two steps than the previous bin.

(14) When stapling for all stacks of sheets are completed, the unit body wherein the aforementioned bin oscillating device 70 and stapling device 80 are united solidly is drawn up by the aforementioned elevator device 90 to return to the position of the uppermost bin and bin shift section 40 returns to its home position to be on a standby condition.

According to the invention, as stated above, a bin oscillating device that oscillates a bin on which the sheets are accepted and stacked for stapling and a stapling device are united solidly to be a unit body, the unit is driven to be elevated or lowered to each bin position by an elevator means, and the bin is oscillated for stapling, in which an elevator guide device for the aforesaid unit body is simple in structure and less play is generated and operation is smooth and sure during ascension, a descent or suspension of the unit body. In addition, the stapling position for sheets is accurate and constant.

What is claimed is:

1. A sorting apparatus for sorting a plurality of sheets transferred from an image forming apparatus, said sorting apparatus sorting the sheets into a plurality of sheet sets and stapling each sheet set, the sorting apparatus comprising:

stacking means, having a plurality of bins arrayed to form a column of bins in an upright direction, for stacking each of said plurality of sheet sets in a respective one of said plurality of bins, each bin being oscillatable in a horizontal direction between a first position where the sheets are stacked, and a second position, where the sheet set is stapled stapling means movable through a plurality of stapling positions in the upright direction of the column of bins for stapling each sheet set at a respective one of said plurality of stapling positions;

a plurality of guide plates, each guide plate respectively guiding a respective one of said plurality of bins between the first position and the second position; and a plurality of return springs, each return spring respectively driving a respective one of said plurality of bins to return from the second position to the first position.

2. The sorting apparatus according to claim 1, further comprising:

hanging means for hanging the stapling means;

an elongated member provided in an upright direction relative to a main body of the sorting apparatus;

a guide member positioned in parallel with the elongated member; and moving means, connected to the hanging means, for moving the stapling means upward and downward relative to said upright direction of the main body of the sorting apparatus by driving the hanging means, so that the elongated member and the guide member restrict movement of the stapling means to the upright direction and substantially prevent movement of the stapling means in another direction.

3. The sorting apparatus of claim 1 wherein, when a last sheet of a sheet set is being discharged for stacking into a given bin of said plurality of bins, another bin positioned directly above the given bin is oscillated to the second position.

4. The sorting apparatus of claim 1 wherein, when a last sheet of a sheet set is being discharged for stacking into a given bin of said plurality of bins, another bin positioned two bins above the given bin is oscillated to the second position.

5. The sorting apparatus of claim 1 wherein, after a last sheet of a sheet set has been discharged for stacking into a given bin of said plurality of bins, another bin having a sheet set stacked therein is positioned directly above the given bin, commences a movement toward the second position and then the sheet set stacked in the another bin is stapled at the second position.

6. The sorting apparatus of claim 1 wherein, after a last sheet of a sheet set has been discharged for stacking into a given bin of said plurality of bins, another bin having a sheet set stacked therein that is positioned two bins above the given bin, commences a movement toward the second position and then the sheet set stacked in the another bin is stapled at the second position.

7. The sorting apparatus of claim 1, further comprising:

hanging means for hanging the stapling means;

an elongated member provided in an upright direction relative to a main body of the sorting apparatus;

a guide member positioned in parallel with the elongated member; and moving means, provided on an upper part of the main body of the sorting apparatus, said moving means being connected to the hanging means, for moving the stapling means in an upward direction relative to said upright direction of said columns of bins by driving the hanging means, so that the elongated member and the guide member restrict a movement of the stapling means to the upright direction of said column of bins and for substantially preventing a movement of the stapling means in another direction.

8. The sorting apparatus of claim 7, wherein the hanging means further comprises a first weight for counterbalancing a second weight that is fixed to a part of the hanging means.

9. The sorting apparatus of claim 1, further comprising a bin oscillating means for oscillating the plurality of bins, and wherein the bin oscillating means and the stapling means are integrated into a single unit.

10. The sorting apparatus of claim 1, wherein the stapling means staples a sheet set on a given bin after a predetermined period of time has elapsed after the given bin has reached the second position.

11. A sorting apparatus for sorting a plurality of sheets transferred from an image forming apparatus, said sorting apparatus sorting the sheets into a plurality of sheet sets and stapling each sheet set, the sorting apparatus comprising:

stacking means, having a plurality of bins, arranged to form a column of bins in an upright direction, said stacking means stacking each of said sheet sets in a respective one of said plurality of bins, each of said plurality of bins being rotatable between a first singular position where the sheet are stacked into a sheet set, and a second angular position where the sheet set is stapled;

stapling means movable in the upright direction of the column of bins for stapling each of said plurality of sheet sets, said stapling means being movable through a plurality of stapling positions, said stapling means stapling the sheet sets at said plurality of stapling positions;

driving means provided on said stapling means for pushing a respective one of said plurality of bins from the first position to the second position; and a return spring connected to a respective one of a plurality of guide plates and to a respective one of said plurality of bins, said return spring pulling said bin from the second position to the first position after the stapling means staples a sheet set in said respective one of said bins.

12. A sorting and stapling apparatus for sorting a plurality of sheets transferred from an image forming apparatus, said sorting and stapling apparatus sorting the sheets into a plurality of sheet sets and then stapling each sheet set, the sorting and stapling apparatus comprising:

means, having a plurality of bins, arranged to form a column of bins in an upright direction for stacking each of said sheet sets in a respective one of said plurality of bins, each of said plurality of bins being rotatable around an axis of rotation between a first angular position, where the sheets are stacked into a sheet set, and a second angular position, where said sheet set is stapled;

stapling means movable in the upright direction of the column of bins, said stapling means being movable through a plurality of stapling positions, each of said plurality of stapling positions corresponding respectively to a position of a respective one of said bins, said stapling means stapling the sheet sets at said plurality of stapling positions;

bin detecting means, for detecting a return of a given bin from the second angular position thereof to the first angular position thereof, after the stapling means staples the sheet set on the given bin; and moving means for initiating a movement of the stapling means from the second angular position of the given bin to a stapling position of another bin after the detecting means detects the return of the given bin to the first angular position thereof.

13. A sorting and stapling apparatus for sorting a plurality of sheets transferred from an image forming apparatus, said sorting and stapling apparatus sorting the sheets into a plurality of sheet sets and then stapling each sheet set, the sorting and stapling apparatus comprising:

means, having a plurality of bins, arranged to form a column of bins in an upright direction for stacking each of said sheet sets in a respective one of said plurality of bins, each of said plurality of bins being rotatable around an axis of rotation between a first angular position, where the sheets are stacked into a sheet set, and a second angular position, where said sheet set is stapled;

stapling means movable in the upright direction of the column of bins, said stapling means being movable through a plurality of stapling positions for stapling the sheet sets at said plurality of stapling positions, each of said plurality of stapling positions corresponding respectively to a position of a respective one of said bins;

an opening provided at a peripheral portion of each bin;

a contact portion provided at an end portion of the opening of each bin;

a supporting shaft mounted in an upright direction, relative to a main body of the sorting and stapling apparatus, said supporting shaft being inserted through each opening of each bin for supporting the plurality of bins at a plurality of regularly spaced intervals;

rotating means for respectively rotating each of the bins around the supporting shaft from the first angular position to the second angular position by exerting a force on the contact portion of each bin;

detecting means for detecting a trailing edge of each sheet when the sheet is being fed into a bin; and counting means for counting a number of sheets that have been fed into a bin, wherein the rotating means rotates a selected one of the bins to the second angular position thereof when a preset total number of sheets of a sheet set are counted by the counting means, to have been stacked on said selected one of said bins.

* * * * *